US008959699B2

(12) United States Patent
Bober et al.

(10) Patent No.: US 8,959,699 B2
(45) Date of Patent: Feb. 24, 2015

(54) MOP HEAD FIXATION DEVICE AND METHOD

(71) Applicant: Diversey, Inc., Sturtevant, WI (US)

(72) Inventors: Andrew M. Bober, Racine, WI (US); Eric R. Evenson, Stockholm, WI (US); Daniel S. Pica, Williams Bay, WI (US); Joseph C. Fields, Farnhamville, IA (US); Axel Schmitz, Gommiswald (CH); Alfred Widmer, Wilen b. Wil (CH); Alexandra M. Berger, West Sussex (GB); Nick Angel, West Sussex (GB); Daniel Meier, Wangi (CH)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/920,893

(22) Filed: Jun. 18, 2013

(65) Prior Publication Data

US 2013/0340187 A1 Dec. 26, 2013

Related U.S. Application Data

(63) Continuation of application No. 12/594,114, filed as application No. PCT/US2008/058588 on Mar. 28, 2008, now Pat. No. 8,464,391.

(60) Provisional application No. 60/909,793, filed on Apr. 3, 2007.

(51) Int. Cl.

| | |
|---|---|
| ***A47L 13/254*** | (2006.01) |
| ***A47L 13/256*** | (2006.01) |
| ***A47L 13/258*** | (2006.01) |

(52) U.S. Cl.

CPC ..... *A47L 13/254* (2013.01); *A47L 13/256* (2013.01); *A47L 13/258* (2013.01)

USPC ..... 15/228; 15/147.1

(58) Field of Classification Search

USPC ..... 15/228, 147.1, 147.2, 229.6, 233

See application file for complete search history.

(56) References Cited

U.S. PATENT DOCUMENTS

| | | | |
|---|---|---|---|
| 227,438 | A | 5/1880 | Lothrop |
| 670,585 | A | 3/1901 | Fowler |

(Continued)

FOREIGN PATENT DOCUMENTS

| | | |
|---|---|---|
| AU | 9741892 | 4/1998 |
| DE | 2537097 | 3/1976 |

(Continued)

OTHER PUBLICATIONS

Partial European Search Report prepared by the European Patent Office, date of completion Feb. 15, 2011.

(Continued)

*Primary Examiner* — Shay Karls

(74) *Attorney, Agent, or Firm* — Micael Best & Friedrich LLP

(57) ABSTRACT

Various embodiments of a mop include a user-manipulatable control operable by a user to generate attachment of a mop pad to a mop head and/or release of the mop pad from the mop head. The user-manipulatable control can be located on a handle of the mop in some embodiments, and on the mop head in other embodiments. Also, an actuator coupled to the user-manipulatable control can be used to move one or more grips, magnet-carrying elements, slides, wings, or clamping members to releasably secure the mop pad to the mop head, or to selectively magnetize one or more magnets for release and/or attachment of the mop pad.

20 Claims, 19 Drawing Sheets

(56) References Cited

U.S. PATENT DOCUMENTS

| | | | |
|---|---|---|---|
| 772,829 | A | 10/1904 | Russell, Jr. |
| 854,742 | A | 5/1907 | Hill |
| 889,088 | A | 5/1908 | Baillargeon |
| 1,031,637 | A | 7/1912 | Fischer |
| 1,362,900 | A | 12/1920 | Severns |
| 1,670,851 | A | 5/1928 | Ferrara |
| 2,134,301 | A | 10/1938 | Guggenbuehler |
| 2,184,358 | A | 12/1939 | Moore |
| 2,261,505 | A | 11/1941 | Schlesinger |
| 2,273,371 | A | 2/1942 | Oberti |
| 2,279,559 | A | 4/1942 | Darling |
| 2,298,380 | A | 10/1942 | Hood |
| 2,300,911 | A | 11/1942 | Cravis |
| 2,325,598 | A | 8/1943 | Fatland |
| 2,402,069 | A | 6/1946 | Minnick et al. |
| 2,440,014 | A | 4/1948 | Ludwick |
| 2,494,878 | A | 1/1950 | Jensen |
| 2,503,997 | A | 4/1950 | Bu Miller |
| 2,504,694 | A | 4/1950 | Jenkins |
| 2,533,733 | A | 12/1950 | Jensen |
| 2,663,042 | A | 12/1953 | Richards et al. |
| 2,668,386 | A | 2/1954 | Benner, Jr. |
| 2,755,498 | A | 7/1956 | Park |
| 2,769,995 | A | 11/1956 | Klein |
| 2,774,089 | A | 12/1956 | Brown |
| 2,873,129 | A | 2/1959 | Edmundson |
| 2,902,703 | A | 9/1959 | Schulman |
| 2,903,730 | A | 9/1959 | Murphy |
| 2,921,327 | A | 1/1960 | Kuehl |
| 2,932,049 | A | 4/1960 | Jenkins |
| 2,955,311 | A | 10/1960 | Jurkanis |
| 3,050,762 | A | 8/1962 | Ballinger |
| 3,098,669 | A | 7/1963 | Fortin et al. |
| 3,235,296 | A | 2/1966 | Day |
| 3,321,863 | A | 5/1967 | Maxam, Jr. |
| 3,324,495 | A | 6/1967 | Van Schwartz et al. |
| 3,333,293 | A | 8/1967 | Skurdelis |
| 3,335,735 | A | 8/1967 | Colegrove et al. |
| 3,355,844 | A | 12/1967 | Abler et al. |
| 3,380,097 | A | 4/1968 | Pharris |
| 3,596,946 | A | 8/1971 | Burton et al. |
| 3,931,968 | A | 1/1976 | Hedberg |
| 4,031,673 | A | 6/1977 | Hagelberg |
| 4,070,726 | A | 1/1978 | Joffre |
| 4,076,437 | A | 2/1978 | Mazzolla |
| 4,134,703 | A | 1/1979 | Hinners |
| 4,184,224 | A | 1/1980 | Joffre |
| 4,225,998 | A | 10/1980 | Thielen |
| 4,231,574 | A | 11/1980 | Williams |
| 4,238,164 | A | 12/1980 | Mazzolla |
| 4,319,379 | A | 3/1982 | Carrigan et al. |
| 4,378,172 | A | 3/1983 | Groschupp |
| 4,419,025 | A | 12/1983 | Takahashi |
| 4,419,026 | A | 12/1983 | Leto |
| 4,464,807 | A | 8/1984 | Weiss |
| 4,509,224 | A | 4/1985 | Batchelor |
| 4,524,484 | A | 6/1985 | Graham |
| 4,585,367 | A | 4/1986 | Gall |
| 4,680,826 | A | 7/1987 | Schunter |
| 4,718,671 | A | 1/1988 | Desmond et al. |
| 4,794,663 | A | 1/1989 | Vosbikian |
| 4,807,323 | A | 2/1989 | Karpp |
| 4,858,926 | A | 8/1989 | Cabianca |
| 4,882,804 | A | 11/1989 | Lucas |
| 4,895,471 | A | 1/1990 | Geltz et al. |
| 4,896,687 | A | 1/1990 | Segal et al. |
| 4,948,149 | A | 8/1990 | Lin et al. |
| 4,949,964 | A | 8/1990 | Jolly |
| 4,961,242 | A | 10/1990 | Kresse et al. |
| 5,029,860 | A | 7/1991 | Ehrich |
| 5,037,235 | A | 8/1991 | Aquilina |
| 5,131,111 | A | 7/1992 | Richardson et al. |
| 5,253,387 | A | 10/1993 | Kresse et al. |
| 5,390,390 | A | 2/1995 | Kresse et al. |
| 5,501,069 | A | 3/1996 | Lentz |
| 5,553,344 | A | 9/1996 | Rosenkrantz |
| 5,850,658 | A | 12/1998 | Specht |
| 5,876,147 | A | 3/1999 | Longo |
| 5,897,268 | A | 4/1999 | Deville |
| 5,937,471 | A | 8/1999 | Liao |
| 6,027,087 | A | 2/2000 | Lindemann et al. |
| 6,032,318 | A | 3/2000 | McLaughlin et al. |
| 6,058,552 | A | 5/2000 | Hanan |
| 6,142,699 | A | 11/2000 | Pao |
| 6,302,614 | B1 | 10/2001 | Tseng |
| 6,367,121 | B1 | 4/2002 | MacMillan |
| 6,412,138 | B1 | 7/2002 | MacMillan |
| 6,606,757 | B2 | 8/2003 | Vosbikian et al. |
| 6,663,071 | B2 | 12/2003 | Peterson |
| RE38,635 | E | 10/2004 | Uemura |
| 6,804,853 | B2 | 10/2004 | Wang |
| 6,983,509 | B2 | 1/2006 | Lin |
| 7,082,641 | B1 | 8/2006 | Jung et al. |
| 7,144,180 | B2 | 12/2006 | Stahle et al. |
| 7,302,745 | B2 | 12/2007 | Stahle |
| 7,313,843 | B2 | 1/2008 | Brinker et al. |
| 7,322,371 | B2 | 1/2008 | You |
| 7,373,708 | B2 | 5/2008 | Stahle et al. |
| 7,488,255 | B2 | 2/2009 | Labes |
| 7,494,296 | B2 | 2/2009 | Stahle |
| 7,690,069 | B2 * | 4/2010 | Chen et al. ..... 15/115 |
| 7,721,377 | B2 | 5/2010 | Jungklaus et al. |
| 7,802,340 | B2 | 9/2010 | Knopow et al. |
| 7,854,455 | B2 | 12/2010 | Ruscil et al. |
| 7,926,452 | B1 | 4/2011 | Kim |
| 8,061,751 | B2 | 11/2011 | Hatcher |
| 8,065,775 | B2 | 11/2011 | Cameneti et al. |
| 8,220,101 | B2 | 7/2012 | Chen |
| 2005/0039286 | A1 | 2/2005 | Brinker et al. |
| 2005/0091775 | A1 | 5/2005 | Lindholm |
| 2007/0022553 | A1 | 2/2007 | Niemeyer et al. |
| 2007/0079854 | A1 | 4/2007 | You |
| 2007/0087844 | A1 | 4/2007 | Labes |
| 2008/0016636 | A1 | 1/2008 | Morris et al. |
| 2008/0131195 | A1 | 6/2008 | Stahle et al. |
| 2009/0245927 | A1 | 10/2009 | Stahle et al. |
| 2010/0281642 | A1 | 11/2010 | Lee |
| 2011/0000044 | A1 | 1/2011 | Chen et al. |
| 2011/0023251 | A1 | 2/2011 | Bober et al. |
| 2011/0095213 | A1 | 4/2011 | Roman |
| 2011/0097136 | A1 | 4/2011 | Roman |
| 2011/0101716 | A1 | 5/2011 | Nolte et al. |
| 2011/0154602 | A1 | 6/2011 | Chen |
| 2011/0185523 | A1 | 8/2011 | Chen |
| 2011/0252591 | A1 | 10/2011 | Perelli et al. |
| 2012/0023764 | A1 | 2/2012 | Bartonlini |
| 2012/0126533 | A1 | 5/2012 | Canale |

FOREIGN PATENT DOCUMENTS

| | | | |
|---|---|---|---|
| DE | 2704417 | | 8/1978 |
| DE | 3142222 | | 5/1983 |
| DE | 3423756 | | 1/1986 |
| DE | 3738408 | | 5/1989 |
| DE | 3743412 | | 5/1989 |
| DE | 3932827 | | 4/1991 |
| DE | 20114744 | | 11/2001 |
| DE | 20114744 | U1 * | 11/2001 |
| EP | 0295843 | | 12/1988 |
| EP | 0336837 | | 10/1989 |
| EP | 0541935 | | 5/1993 |
| EP | 0599227 | | 6/1994 |
| EP | 0599227 | A1 * | 6/1994 |
| EP | 1313956 | | 4/2007 |
| EP | 1825965 | A1 | 8/2007 |
| EP | 1321174 | | 1/2008 |
| EP | 2301406 | | 3/2011 |
| EP | 2383077 | | 11/2011 |
| EP | 1825965 | B1 | 4/2012 |
| FR | 2327749 | | 5/1977 |
| FR | 2662459 | | 11/1991 |
| GB | 608999 | | 9/1948 |
| GB | 1127497 | | 9/1968 |
| GB | 2063352 | | 6/1981 |

(56) References Cited

FOREIGN PATENT DOCUMENTS

| | | |
|---|---|---|
| GB | 2238572 | 6/1991 |
| KR | 1020040017570 | 2/2004 |
| WO | 8806244 | 8/1988 |
| WO | 9107597 | 5/1991 |
| WO | 9220413 | 11/1992 |
| WO | 0218802 | 3/2002 |
| WO | 2005084516 | 9/2005 |
| WO | 2006002919 | 1/2006 |
| WO | 2010116089 | 10/2010 |

OTHER PUBLICATIONS

International Search Report prepared by the Korean Intellectual Property Office.

Supplementary European Search Report, date of completion May 10, 2010.

International Search Report and Written Opinion for Application No. PCT/US2013/039701 dated Oct. 25, 2013 (6 pages).

* cited by examiner

MOP HEAD FIXATION DEVICE AND METHOD

BACKGROUND

Many mops utilize disposable or replaceable mop pads. Such mops are convenient because many can be used in both wet and dry environments, after which time the soiled mop pads can be replaced.

Some mops that accommodate replaceable mop pads require that a tedious or otherwise undesirable process be followed to release the soiled mop pad from the mop head. This process can include inverting the mop, grasping one or more actuators on the mop head, grasping a portion of the soiled mop pad, pulling the mop pad from a securing recess that can be relatively difficult to access, and the like. Replacing the soiled mop pad can require similarly tedious or otherwise undesirable procedures, including positioning and securing the mop pad in a manner requiring a degree of dexterity and hand-eye coordination approaching or exceeding a user's limits. In light of these and other limitations in the prior art, mop head fixation devices and methods in which a mop pad can be easily and quickly removed and/or replaced are welcome additions to the art.

SUMMARY

Some embodiments of the present invention provide a mop adapted to be releasably coupled to a mop pad, the mop comprising: a mop handle; a mop head connected to the mop handle and comprising a mop head body, a portion of the mop head movable with respect to the mop head body between a first position in which the portion engages the mop pad to secure the mop pad to the mop head, and a second position in which the mop pad is released from the portion; and a user-manipulatable control on the mop handle and coupled to the portion of the mop head, the user-manipulatable control operable by a user to actuate the portion of the mop head between the first and second positions.

In some embodiments, a method of detaching a mop pad from a mop head of a mop is provided, and comprises manipulating a control on a handle of the mop; transmitting force from the control on the handle to a portion of the mop head retaining the mop pad; moving the portion of the mop head with respect to a body of the mop head; and releasing the mop pad from the portion of the mop head by moving the portion of the mop head with respect to the body of the mop head.

Further aspects of the present invention, together with the organization and operation thereof, will become apparent from the following detailed description of the invention when taken in conjunction with the accompanying drawings, wherein like elements have like numerals throughout the drawings.

DETAILED DESCRIPTION

Before any embodiments of the invention are explained in detail, it is to be understood that the invention is not limited in its application to the details of construction and the arrangement of components set forth in the following description and/or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As will be understood from this specification, one or more aspects of the present invention relate to a hand held floor maintenance tool having a handle and a head attached to the handle. Such a tool or components thereof can be used for many different tasks, such as cleaning a surface (i.e., mopping), applying a protective coating on a surface (i.e., waxing), removing a coating from a surface (i.e., stripping), and the like. For the sake of simplicity, the floor maintenance tool described herein will be referenced with respect to a commonly used term "mop." However, it is to be understood that this term is not intended to be limiting on the function of the device or method. Rather, this term is used for the sake of simplicity when describing or claiming the device or method. As indicated above, the term "mop" is to be understood to cover not only conventional floor cleaning operations and devices, but also other floor maintenance operations such as waxing, stripping, buffing, etc. Furthermore, components described herein having the term "mop" forming part of the name of the component (e.g., mop head, mop pad, etc.) should not be interpreted as being limited in application to cleaning operations.

Figure 1:
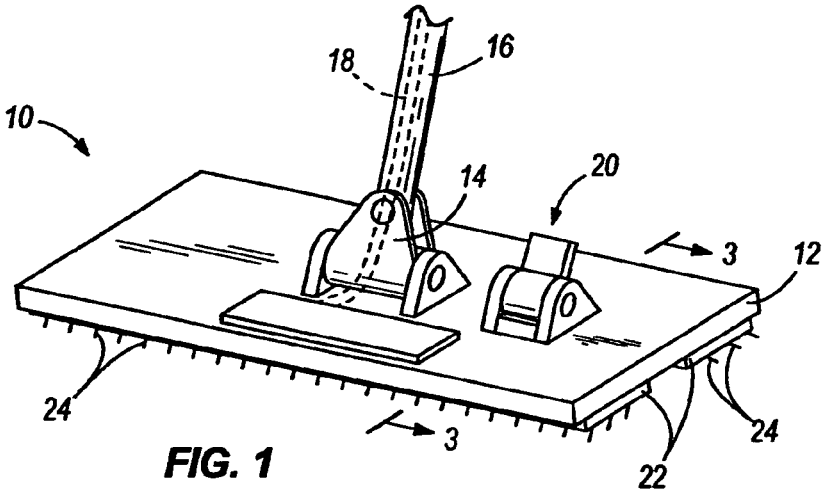
FIG. 1 is a perspective view of a mop head with a user-manipulatable control according to an embodiment of the present invention.
Figure 2:
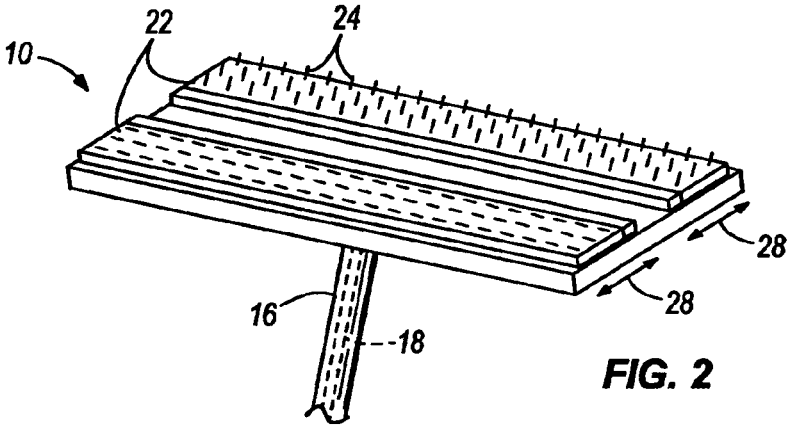
FIG. 2 is a perspective view of the underside of the mop head illustrated in FIG. 1.
Figure 3:
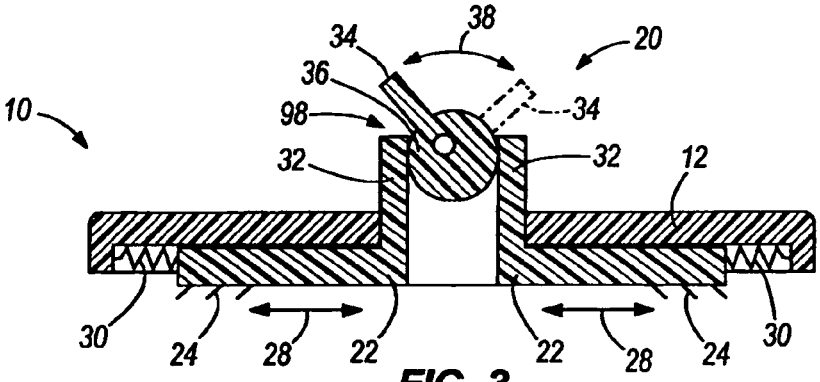
FIG. 3 is a cross-sectional view of the mop head illustrated in FIGS. 1 and 2, taken along line 3-3 of FIG. 1.

A mop head according to an embodiment of the present invention is illustrated in FIGS. 1-3, and is indicated generally at 10. The mop head 10 can be connected to one or more mop pads (not shown) for cleaning surfaces such as floors, walls, ceilings, appliances, furniture, and the like. As used herein and in the appended claims, the term "mop pad" refers to any disposable or non-disposable element releasably connected to the mop head 10 and used for cleaning a surface, applying a fluid or paste to a surface, distributing a fluid or paste across a surface, removing a fluid or paste from the surface, removing debris from a surface, and the like. The term "mop pad" encompasses, without limitation, one or more layers of woven or non-woven material (e.g., paper and/or synthetic sheeting, fabric, and the like), natural and synthetic sponges, rope-type mop elements, and the like. Any of such mop pads can have a backing sheet, frame, bar or bar assembly, or other rigid or flexible structure for providing a degree of strength and stiffness to the mop pad, and/or for providing one or more elements (e.g., ribs, ridges, buttons, or other protrusions, and/or recesses, grooves, slots, holes, or other apertures) by which the mop pad can be releasably connected to the mop head 10 in any of the manners described herein. Mop pads within the scope of the present invention can be connected to the mop head to assemble a sponge mop, wet mop, specialty mop, towel mop, or any other type of mop desired.

The mop head 10 illustrated in FIGS. 1-3 includes a body 12 and an articulated joint 14 to connect the mop head 10 to a handle 16. The handle 16 can be gripped by an operator to direct the mop head 10 for cleaning a floor or other surface. In the illustrated embodiment, the body 12 is rectangular, and includes a substantially flat upper surface which supports the articulated joint 14. In other embodiments, the body 12 can have different shapes, such as square or other polygonal shapes, round shapes, oval shapes, and irregular shapes. The articulated joint 14 permits the handle 16 to pivot in any direction with respect to the mop head 10 to promote uniform or substantially uniform contact between the mop head 10 and a surface to be cleaned. The articulated joint 14 illustrated in FIG. 1 is similar to a U-joint, and provides two degrees of freedom between the handle 16 and the mop head 10. In other embodiments, however, the articulated joint 14 can be replaced with any other joint desired, some of which provide a single degree of freedom between the handle 16 and the mop head 10, others of which provide three degrees of freedom between the handle 16 and the mop head 10. For example, the illustrated articulated joint 14 can be replaced by a ball and socket joint, a piano or door-type hinge, any pin and aperture connection, a telescoping connection to the handle 16, and the like.

In the illustrated embodiment of FIGS. 1-3, the articulated joint 14 does not permit the handle 16 to twist with respect to the mop head 10. In other embodiments, however, the illustrated articulated joint 14 can be replaced with another joint permitting the handle 16 to twist with respect to the head 10 (e.g., about the longitudinal axis of the handle 16), such as by providing a journal bearing or a ball joint at the connection between the handle 16 and the articulated joint 14, or at the connection between the articulated joint 14 and the body 12.

As best shown in FIG. 1, a fluid line 18 and a spray head 19 can also be connected to the mop head 10 for spraying cleaner or other substances onto a surface to be cleaned. In other embodiments, the fluid line 18 does not extend to the mop head 10, and instead extends only to a spray head 19 mounted to the handle 16.

The mop head 10 illustrated in FIGS. 1-3 also includes a user-manipulatable control 20 that can be used to release and/or attach a mop pad (not shown) to the mop head 10 as will be described in greater detail below.

As best shown in FIG. 2, the body 12 of the illustrated mop head 10 carries grips 22 which are adapted to releasably connect to one or more mop pads (not shown). The grips 22 can include a number of protrusions 24 extending away from a body of each grip 22. The protrusions 24 can engage one or more mop pads for releasable attachment thereto. The protrusions 24 can be pins, needles, hooks, and the like comprising metal, plastic, or composite materials, and in some embodiments extend into a surface of the mop pad for engagement of the mop pad to the grip 22. The protrusions 24 can also be defined by hook and loop fastener material used for engagement with mating hook and loop fastener material on the mop pad.

In the illustrated embodiment of FIGS. 1-3, the protrusions 24 are inclined relative to the surface of the grips 22. As best shown in FIGS. 2 and 3, the protrusions 24 are arranged in parallel rows, wherein each row is inclined away from the articulated joint 14. The use of such inclined protrusions 24 can provide a more secure connection between the grips 22 and a mop pad in many embodiments. In other embodiments, however, the protrusions need not necessarily be angled and/or can be located in any other pattern or patternless manner across the grips 22. In some embodiments, such as in the illustrated embodiment of FIGS. 1-3, all of the protrusions 24 on each grip 22 point in substantially the same direction. However, in other embodiments, such as those where the protrusions comprise hook and loop fastener material, the orientation of the protrusions is less important due to the nature of the material.

The grips 22 of the mop head 10 shown in FIGS. 1-3 are slidable with respect to the body 12 in the directions indicated by arrows 28 in FIGS. 1 and 2. As best shown in FIG. 3, biasing members 30 can be positioned between the grips 22 and inner surfaces of the body 12 to bias the grips 22 toward the middle of the body 12. The biasing members 30 illustrated in FIG. 3 are compression coil springs, although in other embodiments any other biasing element can instead be used, including without limitation extension springs (coil or otherwise), leaf springs, torsion springs, elastic bands or other elastic elements, magnets, and the like.

With continued reference to FIG. 3, the user-manipulatable control 20 includes a lever 34. The lever 34 is connected to a cam 36 that functions as an actuator 98 for the grips 22. An operator can move the lever 34 to pivot the cam 36 about an axis substantially parallel to the grips 22. In so doing, the cam 36 pivots with respect to the body 12 in the directions indicated by the arrow 38 in FIG. 3, and exerts motive force against portions 32 of the grips 22. This force causes the grips 22 to move in the direction of arrows 28 as described above. Although the cam 36 shown in FIG. 3 cams against portions of the grips 22 as just described, in other embodiments the cam 36 cams against one or more elements connected to the grips 22 to thereby exert the motive force upon the grips 22.

By pivoting the cam 36 with respect to the body 12 in a first direction, the grips 22 are forced apart in the direction indicated by arrows 28, whereas by pivoting the cam 36 in an opposite direction, the grips 22 are brought together under the force of the biasing members 30. Accordingly, the cam 36 at least partially defines an actuator 98 used to actuate the grips 22. A peak of the pivotal motion occurs when the cam 36 has forced the grips 22 as far apart as possible. In some embodiments, the motion of the lever 34 is limited by the body 12 or an element attached to the body 12 such that when the cam 36 pivots in the first direction to force the grips 22 apart, the lever 34 permits the cam 36 to rotate slightly past the peak of the pivotal motion. This feature, in combination with the force of the biasing members 30, helps to retain the grips 22 in their spread state. In some embodiments, the cam 36 can have a substantially round cross-sectional shape, and can pivot about an axis distal from the center of the cam 36 to provide the pivotal motion for separating the grips 22. In other embodiments, the cam 36 has an oval or irregular shape, and pivots about an axis either distal from or coinciding with the center of the cam 36 to provide the pivotal motion required to separate the grips 22.

A mop pad (not shown) can be attached to the grips by virtue of the movement of the grips 22. By way of example, the function of the mop head 10 will now be described with reference to a cleaning cloth, although any of the other types of mop pads described above can instead be utilized in other embodiments. The cleaning cloth (not shown) can be secured to the mop head 10 by first moving the lever 34 to pivot the cam 36 in a direction permitting the grips 22 to move toward one another under force from the biasing members 30. Next, the cleaning cloth can be laid on a floor or other surface, and the head can be then be positioned over the cleaning cloth such that the protrusions 24 contact the cleaning cloth. Finally, an operator can actuate the lever 34 to pivot the cam 36 in an opposite direction, thereby forcing the grips 22 apart. The protrusions 24 engage the cleaning cloth, and can pull the cleaning cloth taut across the bottom of the head 10 as the grips 22 are forced apart. By virtue of the angled orientation of the protrusions 24 illustrated in FIGS. 1-3, the protrusions 24 will not easily release the cleaning cloth while the grips 22 are held apart. As explained above, the grips 22 can be retained in their spread state because the cam 36 has pivoted slightly past the peak of its pivotal motion. The cleaning cloth can easily be removed by actuating the lever 34 to pivot the cam 36 again, thereby permitting the grips 22 to move closer together and release the cleaning cloth from the protrusions 24.

The method of securing a cleaning cloth as described above can provide significant advantages in that an operator does not have to bend down or otherwise perform a tedious procedure to install and remove mop pads from the mop head 10. A mop pad can simply be placed on the floor or other surface, and the mop head 10 can be positioned on and in engagement with the mop pad. An operator can then actuate the lever 34 with a foot to secure the mop pad to the mop head 10. The operator could of course use a hand to actuate the lever 34, or also invert the mop and place the mop pad on the grips 22, if desired. Releasing the mop pad is as simple as moving the lever 34 in the opposite direction with a foot or hand, and lifting the mop head 10 from the cleaning cloth. In other embodiments, other types of user-manipulatable controls and actuators can be used to spread the grips 22 apart. For example, the user-manipulatable control 20 can include a button that can be pressed with a hand or a foot, wherein the actuator can be defined by any suitable mechanism (e.g., one or more inclined walls engaged by the button upon depression) to transmit such force for spreading the grips 22 apart. As another example, the user-manipulatable control 20 can include a lever that slides along a slot to push or pull at least one of the grips 22, and can be actuated by either a hand or a foot.

In some embodiments, the mop pad (not shown) is substantially the same size as the mop head 10. However, in other embodiments, it may be desirable to use a mop pad that is slightly larger than the mop head 10. In such embodiments, additional protrusions 24 can be positioned on the sides and/or top surface of the body 12 to permit the mop pad to be wrapped around at least a portion of the body 12 for attachment to the sides and/or top surface of the body 12. Removal of such mop pads may or may not require an operator to release the mop pad from the top surface of the body 12 prior to actuating the lever 34 to release the cleaning cloth as described above.

Although the mop head 10 illustrated in FIGS. 1-3 has two grips 22, it should be noted that the mop head 10 can have any other number of grips 22 for attachment to a mop pad, any one or more of which can be movable to secure and release the mop pad in any of the manners described herein. For example, in some embodiments the mop head 10 has only a single movable grip 22 with protrusions 24, wherein further protrusions 24 are located on a stationary portion of the mop head 10 (such as on an underside surface of the body 12). As another example, the mop head 10 can have three or more separate grips 22 actuatable by any number of actuators and corresponding user-manipulatable controls 34 described above. In this regard, any of the mop heads 10 described herein can be used for detachably securing two or more mop pads, such as separate front and rear mop pads, separate laterally-disposed mop pads, and the like, each of which can be secured and released by a dedicated actuator and grip(s) 22, or which can share an actuator and/or user-manipulatable control with one or more other mop pads.

The grips 22 illustrated in FIGS. 1-3 are movable by the cam 36 in generally forward and rearward directions as indicated by the arrows 28 in FIGS. 2 and 3. In such movement, the distance between protrusions 24 can be increased and decreased, thereby permitting the protrusions to grip and release the mop pad as described above. In other embodiments, the grips 22 can be movable in other manners facilitating a similar relationship between the protrusions 24. For example, the grips 22 can be on opposite lateral sides of the mop head 10, and can be movable laterally with respect to the mop head 10 (as opposed to forward and rearward movement as shown in FIGS. 2 and 3). In these embodiments, either or both of the grips 22 can be biased in a direction in any of the manners described above, such as by springs biasing the grips 22 generally toward one another. Accordingly, any number of biasing members 30 can be positioned as necessary to bias the grips 22 based upon the orientation of the grips 22 and the direction of movement of the grips 22. For example, in the embodiment just described in which the grips 22 are laterally movable toward and away from one another, each grip 22 can be biased by one or more biasing members 30 (e.g., springs) positioned between the grips 22 and lateral sides of the body 12, or by one or more biasing members 30 extending between and connecting the grips 22. Still other biasing member locations are possible, and fall within the spirit and scope of the present invention.

In those embodiments where the grips 22 are oriented for movement in directions other than forward and rearward directions as shown in FIGS. 2 and 3, the cam 36 or other actuator can similarly be reoriented to generate the desired grip movement 22 as necessary. Similarly, the lever 34 or other user-manipulatable device can also be oriented as necessary to permit user actuation of the cam 36 or other actuator. For example, in the embodiment described above in which the grips 22 are movable laterally with respect to one another, the grips 22 can be actuated by a cam 36 and lever 34 similar to that shown in FIGS. 1 and 3, but positioned to rotate about an axis extending in a generally forward-rearward direction. Any other user-manipulatable control and actuator (and orientation of each) for moving one or more grips 22 as described herein can instead be used, and falls within the spirit and scope of the present invention.

Although the protrusions 24 described above in connection with the embodiment of FIGS. 1-3 are located on the grips 22, the protrusions 24 can instead or also be located on the mop pad, in which case protrusions 24 can extend into a fabric, paper, or other penetrable material on the grips 22 in order to establish a releasably secured relationship similar to that described above in connection with FIGS. 1-3.

FIGS. 4-10 illustrate alternative embodiments of a mop head according to the present invention. Accordingly, with the exception of mutually inconsistent features and elements between the embodiments of FIGS. 4-10 and the embodiment of FIGS. 1-3, reference is hereby made to the description above accompanying the embodiments of FIGS. 1-3 for a more complete description of the features and elements (and the alternatives to the features and elements) of the embodiments of FIGS. 4-10. Features and elements in the embodiment of FIGS. 4-10 corresponding to features and elements in the embodiments of FIGS. 1-3 are numbered in respective hundreds series of reference numbers (e.g., 112, 212, 312, and the like).

Figure 4:
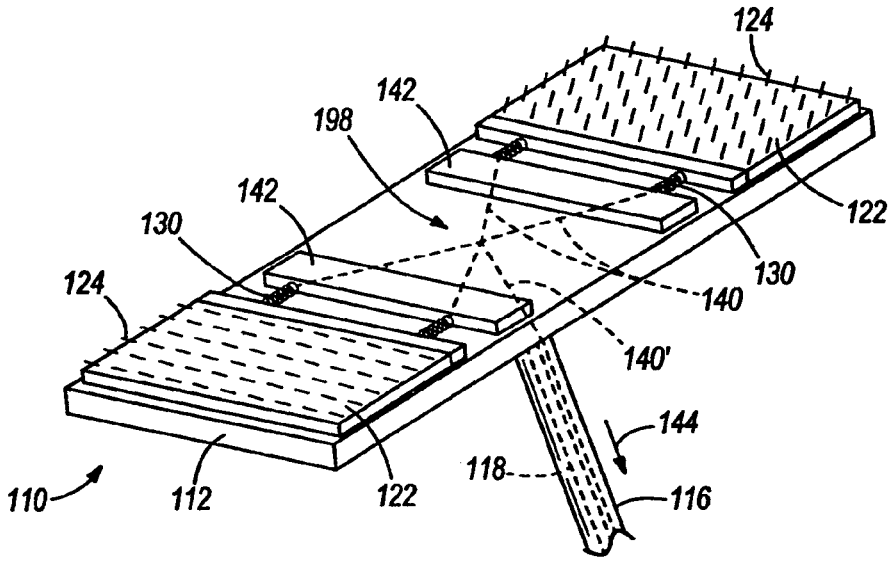
FIG. 4 is a bottom perspective view of a mop head according to another embodiment of the present invention.

FIG. 4 illustrates an embodiment of the mop head 110 having grips 122 positioned on different portions of the mop head 110 than the mop head 10 shown in FIGS. 1-3. The mop head 110 shown in FIG. 4 is has two opposite grips 122, one positioned on either lateral side of the mop head 110 (i.e., in the longitudinal direction of the mop head 110). Rather than utilize a cam 36 as the actuator for the grips 122 as shown in the embodiment of FIGS. 1-3, the mop head 110 illustrated in FIG. 4 utilizes an actuator 198 defined at least in part by cables 140, 140' coupled to the grips 122 and extending through the handle 116. The cables 140, 140' can include a set of cables 140 each attached to a grip 122, and another cable 140' connected to the set of cables 140 and extending within the handle to a user-manipulatable control (not shown) also located on the handle 116. By pulling upon the cables 140, 140', the grips 122 can be moved to different positions with respect to one another, thereby moving the protrusions 124 described in greater detail above.

The cables 140, 140' illustrated in FIG. 4 are metal multi-stranded flexible elements capable of transmitting a mechanical pulling force upon the grips 122 as described herein. However, it will be appreciated that a number of other flexible elements can instead be utilized for this purpose, including without limitation wire, cord, rope, strapping, and the like manufactured from metal, rubber, plastic, nylon, and other polymer materials, and the like. As used herein and in the appended claims, the term "cable" refers to all such alternative elements.

The mop head 110 illustrated in FIG. 4 provides an example of how the biasing members 130 can be positioned to bias one or more grips 122 away from one another (i.e., in an outward direction). In this regard, the illustrated mop head 110 includes walls 142 to which the biasing members 130 are connected for exerting such biasing force against the grips 122. In the illustrated embodiment of FIG. 4, one wall 142 and a pair of biasing members 130 are positioned proximate each grip 122 such that as the cable 140' is pulled upward in the direction of the arrow 144 by a user-manipulatable control (not shown), the biasing members 130 are compressed between the grips 122 and the wall 142. In other embodiments, a single wall 142 is located between the grips 122, wherein one or more biasing members 130 are located between the wall 142 and each grip 122 to exert the biasing force just described. In still other embodiments, one or more biasing members 130 extend between and are connected to both grips 122, thereby biasing the grips 122 without the use of walls 142.

The cables 140, 140' illustrated in FIG. 4 is only one example of the manner in which a cable system can be connected to one or more grips 122 for moving the grips 122. In other embodiments, each of the cables 140, 140' can extend through the handle 116 and to the user-manipulatable control used to pull the cables 140, 140'. Alternatively, any two or more of the cables 140, 140' can be connected together at any location to distribute pulling force exerted thereon in any manner desired. Any number of such cable connections can exist within the body 112 of the mop head 110 and/or within the handle 116 as desired. In this regard, the cables 140, 140' can be routed through the handle 116 and body 112 by appropriate apertures, walls, posts, rollers, and the like for transmission of pulling force upon any desired locations of the grips 122.

The cable actuator 198 described above in connection with FIG. 4 can be utilized to move either or both grips 22 in the illustrated embodiment of FIGS. 1-3, and can be utilized to move any of the grips in any of the mop head embodiments described and/or illustrated herein.

Figure 5:
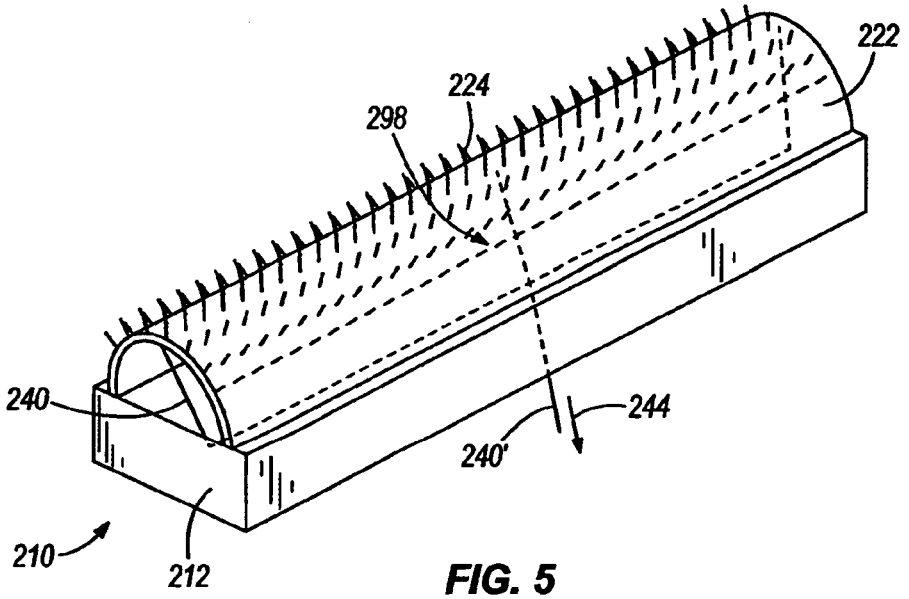
FIG. 5 is a bottom perspective view of a mop head according to another embodiment of the present invention.

Similar to the previous embodiments, the mop head 210 illustrated in FIG. 5 has a grip 222 having a number of protrusions 224 releasable engagement with a mop pad (not shown). The grip 222 illustrated in FIG. 5 is a flexible member capable of being deformed from the state shown in FIG. 5 to an at least partially collapsed state, in a manner similar to a collapsible travel comb. The grip 222 can be manufactured from deformable plastic, nylon, rubber, urethane, or other deformable material having a memory urging the grip 222 to return to the state shown in FIG. 5. A cable 240 extends through a mop handle (not shown) for connection to additional cables 240' extending and connected to the grip 222. Accordingly, the cables 240, 240' at least partially define an actuator 298 for the grip 222. Any of the alternative cable actuators described above in connection with the embodiment of FIG. 4 can be utilized as alternatives to the cables 240, 240' shown in FIG. 5.

By pulling on the cables 240, 240' described above, a portion of the grip 222 is pulled in the general direction shown by arrow 244 in FIG. 5, thereby deforming the grip 222 and moving the protrusions 224 thereon. This movement of the protrusions 224 causes the protrusions 224 to disengage from a mop pad (not shown). To engage a mop pad with the grip 222 and protrusions 224 thereon, the user presses the grip 222 of the mop head 210 against the mop pad, and releases the cables 240, 240'. In this manner, the grip 222 returns to its original shape shown in FIG. 5, pulling the mop pad taut against the surface of the grip 222. The mop can then be used as desired.

In other embodiments, the grip 222 can have any other shape desired (e.g., flat, slightly bowed inward or outward, and the like), whereby pulling of the cables 240, 240' causes the grip 222 to deform and the protrusions 224 to move. Such movement can generate release of a mop pad as described above. In some embodiments, the grip 222 can be deformed by a pushing force, such as by a rod, tube telescoping within the mop handle, and the like. In such embodiments, the grip 222 can be pushed outwardly (i.e., in a direction substantially opposite that indicated by arrow 244 in FIG. 5) to cause the protrusions 224 to move and release a mop pad, and can retract to a relaxed state in which the protrusions 224 grip a mop pad. Any actuator capable of transmitting a pushing force as just described can also be used in place of one or more cables to transmit a pulling force to the grip(s) 222.

Figure 6:
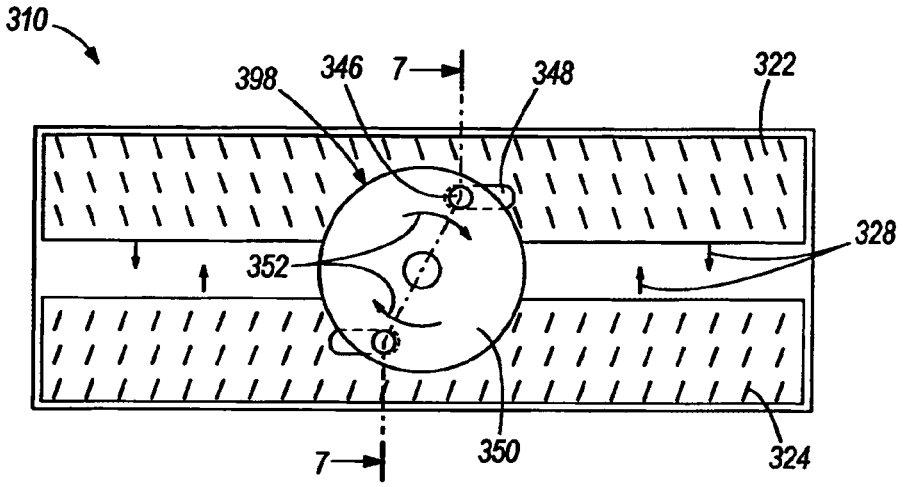
FIG. 6 is bottom plan view of a mop head and actuator according to another embodiment of the present invention.
Figure 7:
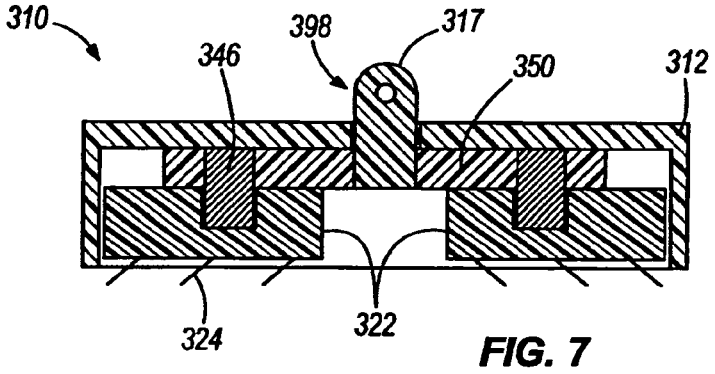
FIG. 7 is a cross-sectional view of the mop head and actuator illustrated in FIG. 6, taken along line 7-7 of FIG. 6.

FIGS. 6 and 7 illustrate a mop head 310 according to another embodiment of the present invention, and provide an example of the manner in which one or more grips 322 can be actuated to move by using another type of actuator (i.e., as an alternative to the cam 36 illustrated in FIGS. 1-3 and the cables 140, 140', 240, 240' illustrated in FIGS. 4 and 5). In the illustrated embodiment of FIGS. 6 and 7, the mop head 310 can be connected to a handle (not shown) about a mounting boss 317 in a pinned or other hinged connection. This connection can define a single degree of freedom in which the handle can pivot with respect to the mop head 310, or can define additional degrees of freedom based upon the type of joint selected for mounting to the mounting boss 317. For example, the mounting boss 317 can be connected to a mop handle via a universal joint to permit multiple degrees of freedom of the mop head 310.

The mop head 310 illustrated in FIGS. 6 and 7 includes a body 312 and two grips 322, although any other number of grips 322 can be used in other embodiments. Like the grips 22, 122, 222 described in earlier embodiments, the grips 322 shown in FIGS. 6 and 7 are movable with respect to the housing 312 in order to releasably engage a mop pad as described in greater detail above. More specifically, the grips 322 illustrated in FIGS. 6 and 7 are movable in the directions indicated by arrows 328, and have a number of inclined protrusions 324 for releasable engagement with a mop pad (not shown). In other embodiments, any other number of grips 322 positioned in any other manner can be used, and can be actuated as will now be described.

The mounting boss 317 can be connected to a rotatable cam 350 located in the body 312 between the grips 322. In some embodiments, the mounting boss 317 is integral with the cam 350, whereas in other embodiments, the mounting boss 317 is a separate element directly or indirectly connected to the cam 350. The cam 350 in the illustrated embodiment includes pins 346 which engage longitudinally-extending slots 348 in the grips 322. In other embodiments, the cam 350 can be connected to the grips 322 through other types of protrusions (e.g., bumps, walls, ribs, and the like) received within the longitudinally-extending slots 348 in the grips 322. In any of these embodiments, rotation of the cam 350 can generate movement of the grips 322 in the directions shown by the arrows 328 in FIG. 6. Accordingly, the cam 350, pins 346, and mounting boss 317 at least partially define an actuator 398 used to move the grips 322.

By virtue of the connection described above between the mounting boss 317 and the mop handle (not shown), when the handle is twisted, the cam 350 pivots with respect to the body 312 in the directions indicated by arrows 352. When the cam 350 pivots with respect to the body 312 in a first direction, the pins 346 engage the slots 348 in the grips 322 to force the grips 322 apart. Likewise, when the cam 350 pivots with respect to the body 312 in a second opposite direction, the pins 346 pull the grips 322 closer together. The peaks of the pivotal motion of the cam 350 occurs when the cam 350 has forced the grips 322 as far apart as possible and has brought the grips 322 as close together as possible. In some embodiments, the pivoting motion of the cam 350 can be limited by the joint between the mounting boss 317 and the handle, whereas in other embodiments, the pivoting motion of the cam 350 is limited by the size, shape, and/or positions of the slots 358 and pins 346. In either case, the limits of pivoting motion of the cam 350 can be slightly past the peaks of the pivotal motion of the cam 350 described above.

It will be appreciated that the particular positions and orientations of the slots 348 shown in FIGS. 6 and 7 are only one example of such a connection that can be used to transmit rotational force of the cam 350 to movement of the grips 322. In other embodiments, the slots 348 are positioned and oriented in any other manner still permitting the movable pinned connection described above. Any number of pins 346 and slots 348 can be used to connect each grip 322 to the cam 350. Also, other types of apertures can be utilized to provide the same relationship between the pins 346 and the grips 322, in which cases the apertures can be oversized to permit movement of the pins 346 therein as the cam 350 is rotated.

As an alternative to the use of pins 346 or other protrusions received and movable within slots 348 or other apertures in the grips 322, the locations of these features can be reversed. For example, one or more of the grips 322 can have a pin or other protrusion extending into a slot or other aperture in the cam 350. In any of these embodiments, rotation of the cam 350 generates movement of the grips 322 in the directions shown by the arrows 328 in FIG. 6.

Although the cam 350 can act upon the grips 322 through pin and slot connections as described above, in other embodiments the rotational force of the cam 350 can move the grips 322 by pushing a peripheral edge of the rotating cam 350 against an adjacent edge of each grip 322. For example, the cam 350 can have lobes or otherwise be shaped to push the grips 322 apart as the cam 350 is rotated, and to permit the grips 322 to move toward one another (e.g., under biasing force from one or more springs, in some embodiments) when the lobes are rotated away from the grips 322. Other manners of transmitting rotational force from the cam 350 to one or more grips 322 are possible, and fall within the spirit and scope of the present invention. In any of the embodiments described herein in connection with FIGS. 6 and 7, any number of biasing members can be connected to any or all of the grips 322 in order to bias the grips 322 toward or away from one another.

A mop pad (not shown) can be secured to the mop head 310 of FIGS. 6 and 7 in a manner similar to that of the embodiment of FIGS. 1-3. However, rather than actuate a lever to separate the grips 322, an operator can twist the handle (not shown), and therefore the mounting boss 317, in a first direction to separate the grips 322 and engage the mop pad with the protrusions 324 on the grips 322. The mop pad can be easily removed by again twisting the handle to pivot the cam 350 in an opposite direction, thereby permitting the grips 322 to move closer together and releasing the mop pad from the protrusions 324. Like the embodiments of FIGS. 4 and 5, a mop pad can be attached to the mop head 310 and/or released from the mop head 310 from a remote location on the handle without requiring a user to touch the mop head 310 or mop pad with his or her hand.

Figure 8:
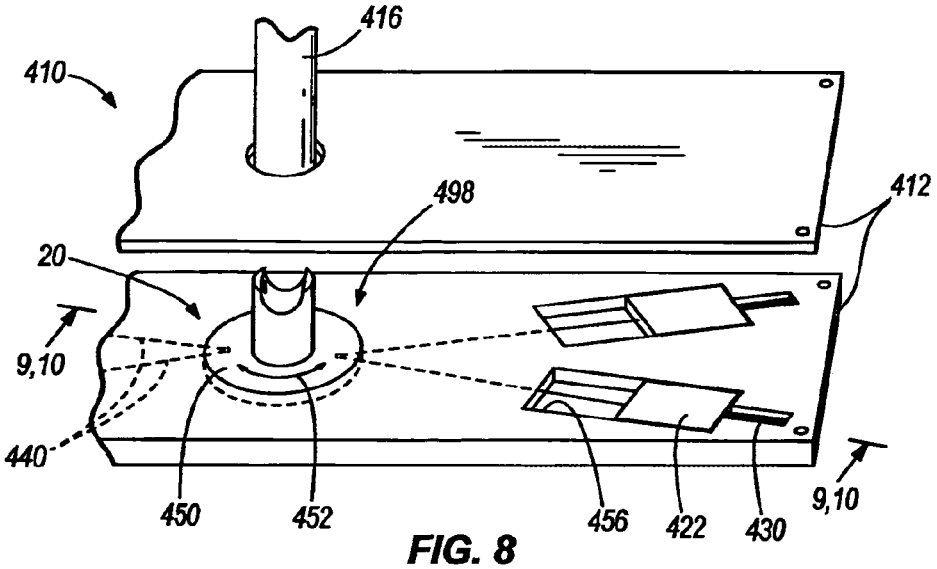
FIG. 8 is a partially exploded perspective view of a mop head according to another embodiment of the present invention.
Figure 9:
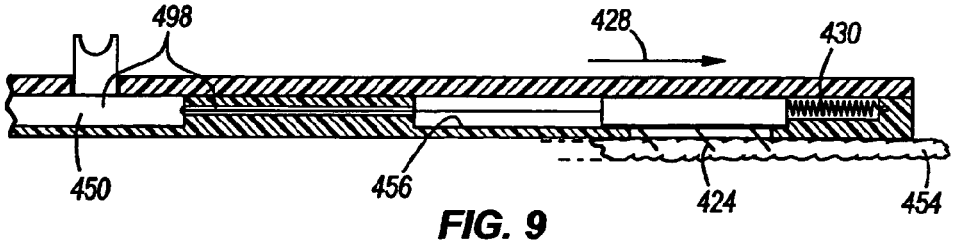
FIG. 9 is a cross-sectional view of the mop head illustrated in FIG. 8, taken along line 9-9 of FIG. 8, and showing a mop pad attached to the mop head.
Figure 10:
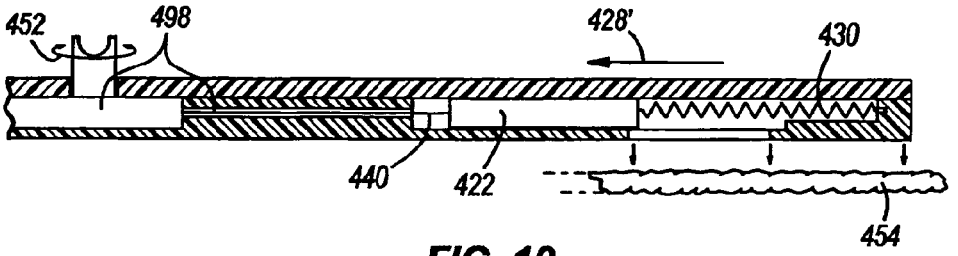
FIG. 10 is the cross-sectional view of FIG. 9, showing the mop pad being detached from the mop head.

FIGS. 8-10 illustrate a mop head according to another embodiment of the present invention. The mop head 410 shown in FIGS. 8-10 has four moving grips 422 with protrusions 424 used to releasably engage a mop pad 454 in a manner similar to that described above in connection with the embodiments of FIGS. 1-7. FIGS. 8-10 provide yet another example of the manner in which any number of grips 422 can be located in any positions on the mop head 410 and can be movable with respect thereto in any manner capable of causing the protrusions 424 to releasably engage and retain a mop pad 454 by virtue of the grip movement. In the illustrated embodiment of FIGS. 8-10, one movable grip section 422 is located in each corner of the mop head 410, and is normally biased outward by biasing members 430 (which can be extension springs, in some embodiments). Each grip 422 can be positioned in a respective channel 456 in the mop head body 412 to help insure the grips 422 only move in two opposite directions described in greater detail below. Each grip 422 is connected by a cable 440 to a collar 450 or other element attached to the mop handle 416. Accordingly, the cables 440 and the collar 450 at least partially define an actuator 498 for moving the grips 422.

In order to release a mop pad 454 from the mop head 410 illustrated in FIGS. 8-10, the mop handle 416 is pivoted to pull the cables 440 and grips 422 in a generally inward direction as shown by arrow 428' in FIG. 10. In this manner, the protrusions 424 on the grips 422 are retracted from and release the mop pad 454. In other embodiments, the cables 450 can be routed through the body 412 of the mop head 410 and can be attached to the grips 422 in order to pull the grips 422 in the outward directions described above, in which cases the grips 422 can be returned to their retracted positions by different and/or appropriately re-positioned biasing members 430.

In some embodiments, the grips 422 move past one or more walls or other portions of the mop head body 412 to assist in releasing the mop pad 454 from the grips 422. In the illustrated embodiment of FIGS. 8-10 for example, the grips 422 are retracted past a portion of the mop head body 412 when the mop handle 416 is twisted sufficiently in the direction shown by arrow 452 in FIG. 8. A similar mop pad releasing feature can be utilized in connection with any of the other embodiments of the present invention described herein.

To attach a mop pad 454 to the mop head 410 shown in FIGS. 8-10, the mop head 410 is placed in contact with the mop pad 454, and the mop handle 416 is pivoted in a direction opposite to that described above, thereby permitting the biasing members 430 to pull the grips 422 outwardly as shown by the arrow 428 in FIG. 9. The inclined protrusions 424 on the grips 422 are again exposed through the body 412 of the mop head 410, and engage the mop pad 454 to a greater and greater extent as the grips 422 move in the outward directions.

As discussed above in connection with the embodiment of FIGS. 1-3, any number of grips 422 can be used as desired, and any one or more of the grips 422 can be stationary. By way of example only, in other embodiments, the mop head 410 only has two grips 422 positioned in opposite corners of the mop head 410. Also, one or more of the grips 422 on one side of the mop head 410 can be stationary, while one or more grips 422 on the opposite side of the mop head 410 can move in response to twisting the mop handle 416 in order to secure and release the mop pad 454.

Although the grips 422 illustrated in FIGS. 8-10 are attached to the mop handle 416 by cables 440, in other embodiments the twisting motion of the mop handle 416 can be transmitted to motion of the grips 422 by other types of connections. For example, the collar 450 in FIGS. 8-10 can be connected to each grip 422 by a respective rigid link (not shown) rotatably pinned to the collar 450. In such embodiments, the grips 422 need not necessarily be biased by biasing members 430, and can instead be returned to their extended positions by twisting the mop handle 416. Still other manners of connecting the mop handle 416 to the grips 422 for transmission of twisting force to grip movement are possible, and fall within the spirit and scope of the present invention.

FIGS. 11-14 illustrate alternate constructions of mop heads and attachment actuators and controls according to additional embodiments of the present invention. These embodiments employ some of the same structure and have some of the same properties as the mop head embodiments described above in connection with FIGS. 1-10. Accordingly, the following description focuses primarily upon the structure and features that are different than the mop head embodiments described above in connection with FIGS. 1-10. Reference should be made to the description above in connection with FIGS. 1-10 for additional information regarding the structure and features, and possible alternatives to the structure and features of the mop heads illustrated in FIGS. 11-14 and described below. Structure and features of the elements shown in FIGS. 11-14 are designated hereinafter in respective hundreds series of reference numbers, starting with values in the 500 series.

Figure 11:
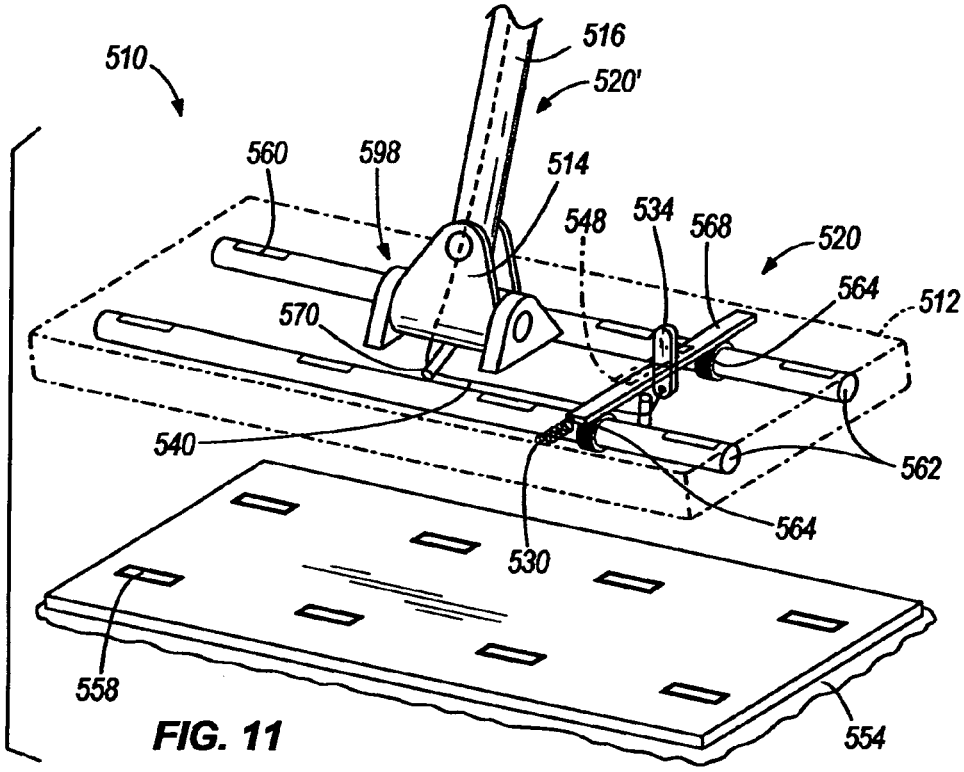
FIG. 11 is a perspective view of a mop head and mop pad according to another embodiment of the present invention.
Figure 12:
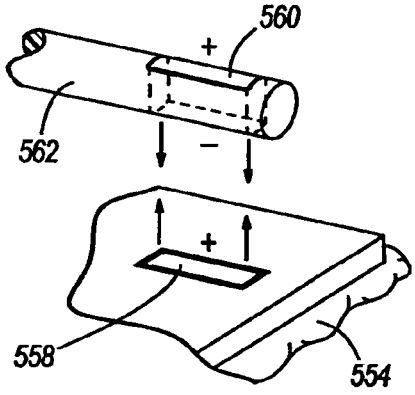
FIG. 12 is a close-up perspective view of FIG. 11, showing the mop pad being attached to the mop by the actuator of FIG. 11.
Figure 13:
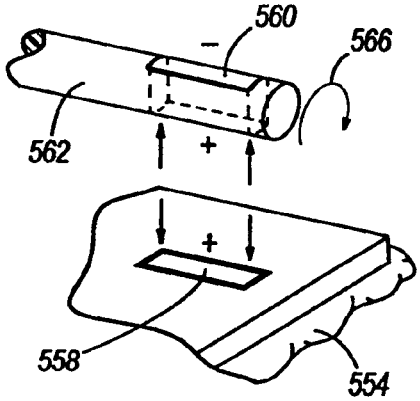
FIG. 13 is a close-up perspective view of FIG. 11, showing the mop pad begin detached from the mop head.

FIGS. 11-13 illustrate a mop head 510 having magnets 560 positioned therein for selective attraction to magnets 558 in a mop pad 554. In the illustrated embodiment, the mop pad 554 has two rows of fixed magnets 558, which can be secured in place in or on the mop pad 554 in a number of different manners. For example, the magnets 558 can be sewn on or in the mop pad 554, can be secured thereto or therein with adhesive or cohesive bonding material, can be received within pockets in or on the mop pad 554, and the like.

The magnets 560 of the mop head 510 illustrated in FIGS. 11-13 are positioned in two rows that can be aligned with the two rows of the mop pad magnets 558 described above. In this regard, the magnets 560 can be positioned along tubes 562 or other members extending to locations corresponding to the magnets 558 in the mop pad 554.

The tubes 562 illustrated in FIGS. 11-13 can be actuated to move the magnets 560 into and out of positions in which the magnets 560 attract the magnets 558 in the mop pad 554. In the illustrated embodiment, the actuator 598 used for this purpose includes the tubes 562, pinions 564 on the tubes 562, and a rack 568 drivably engaged with the pinions 564. By movement of the rack 568, the pinions 564 (and therefore the tubes 562) rotate, thereby changing the positions of the mop head magnets 560. This movement is indicated by arrow 566 in FIG. 13. The rack 568 can be moved in a number of different manners, including a user-manipulatable control 534 (e.g., a lever in the illustrated embodiment of FIGS. 11-13) directly or indirectly connected to the rack 568. This user-manipulatable control 534 can extend through a slot 548 or other aperture to a location outside of the mop head body 512 for access by a user. Alternatively or in addition, the rack 568 can be moved by a cable 540 functioning as another part of the actuator. The cable 540 can extend from the rack 568 and into the mop handle 516 by passing around any number of pins, walls, rollers, or other elements 570. The cable 540 can be connected to a user-manipulatable control (not shown in FIGS. 11-13, but illustrated and described in greater detail below) on the mop handle 516 so that a user can pull upon the cable 540 to move the rack 568.

Any number of tubes 562 or other magnet-carrying elements can be actuated in a number of other manners, such as by wrapping the cable 540 about one or more of the tubes 562, by shifting the tubes 562 within the body 512 using the cable 540, by a lever 534 or other user-manipulatable control (in which case the magnets 560 on the tubes 562 can be shifted to and from positions in which the magnets are shrouded by one or more parts of the mop head body 512), and the like. Although any of the actuation systems described herein can be manually actuated by a user to actuate the tubes 562 or other magnet-carrying elements, any of these systems can instead be powered. For example, the rack 568 in the illustrated embodiment of FIGS. 11-13 can be actuated by a solenoid or electromagnet set, by a motor, or in any other manner. As another example, the cable 540 in the illustrated embodiment of FIGS. 11-13 can be actuated by a motor, a rack and pinion assembly and motor attached to the cable 540, or in any other manner. As yet another example, any of the tubes 562 in the illustrated embodiment of FIGS. 11-13 can be directly connected to a motor for rotation. In any embodiments in which the actuation system of the mop head 510 is powered, one or more user-manipulatable electrical controls can be used to control the actuation system, such as one or more buttons, switches, dials, slides, and the like. Such controls can be located anywhere on the handle 516 for user convenience, but can instead be located in a user-accessible location on the mop head 510 (e.g., body 512) in other embodiments.

In the illustrated embodiment of FIGS. 11-13, at least one biasing member 530 (e.g., a coil spring) is provided to normally bias the rack 568 into a position in which the magnets 560 of the mop head 510 attract and retain the magnets 558 of the mop pad 554. In other embodiments, one or more biasing members 530 of any type can be used to directly or indirectly bias the tubes 562 or other magnet-carrying elements of the mop head 510, including without limitation a biasing member pushing and/or pulling the user-manipulatable control 534, a biasing member directly connected to a tube 562 to exert a torque thereon, a biasing member connected to the cable for biasing the cable in a direction (in which case the cable can be of a type capable of exerting pulling and pushing force, such as a Bowden cable), and the like. The biasing member can be of any type, including those described above in connection with the embodiment of the present invention shown in FIGS. 1-3.

To attach a mop pad 554 to the mop head 510 illustrated in FIGS. 11-13, the mop head 510 is placed in contact with the mop pad 554, such as by placing the mop head 510 upon a mop pad 554 lying on a floor or other surface. The magnets 560 of the mop head 510 illustrated in FIGS. 11-13 are normally positioned to attract the magnets 558 of the mop pad 554, as shown in FIG. 12. To release the mop pad 554 from the mop head 510, the operator actuates a user-manipulatable control (not shown in FIGS. 11-13, but illustrated and described in greater detail below) on the handle 516 and connected to the cable 540, or the user-manipulatable control on the mop head 510 to pivot the magnets 560. When pivoted to positions such as that shown in FIG. 13, the magnets 560 of the mop head 510 repel the magnets 558 in the mop pad 554. In some embodiments, the mop pad 554 can thereby be released from the mop head 510 without requiring the user to touch the mop pad 554.

In some embodiments, one or more electromagnets can be used to releasably attach a mop pad to a mop head. In such embodiments, one or more of the electromagnets can have no charge or substantially no charge when not supplied with an electrical current, and can have a positive or negative charge when supplied with an electrical current. Alternatively, one or more of the electromagnets can have no charge or substantially no charge when supplied with an electrical current, and can have a positive or negative charge when not supplied with an electrical current. In still other embodiments, one or more of the electromagnets can reverse in polarity when an electrical current is supplied thereto.

Figure 14:
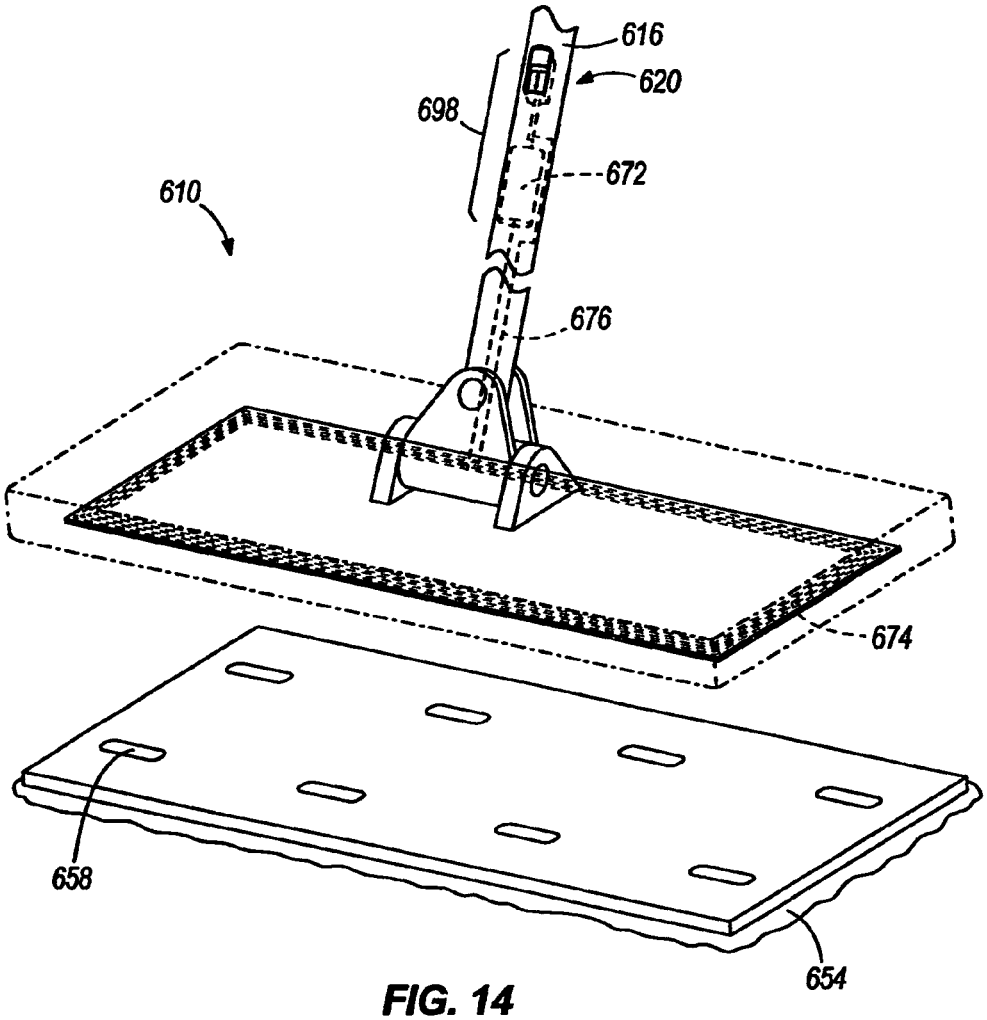
FIG. 14 is a perspective view of a mop head and mop pad according to another embodiment of the present invention.

FIG. 14 illustrates an embodiment of a mop head 610 having an electromagnet 674 for use in releasably attaching a mop pad 654 having a number of magnets 658 (described in greater detail above in connection with the illustrated embodiment of FIGS. 11-13). The electromagnet 674 illustrated in FIG. 14 is generally rectangular in shape, and has a perimeter that can be magnetized by application of electrical current thereto. The electromagnet 674 is selectively magnetized by an electrical current supplied by a battery 672. Although the battery 672 is shown in the handle 616, the battery 672 can instead be located in the mop head 610 in other embodiments. Electrical current can be supplied to the electromagnet 674 by lead wires 676 extending between the battery 672 and the electromagnet 674. When energized with the electrical current, the electromagnet 674 attracts the magnets 658 of the mop pad 654. A user-manipulatable control 675 (e.g., a switch) on the handle 616 can be provided to interrupt this flow of electrical current, thereby causing the electromagnet 674 to lose some or all of its attractive force, and in some embodiments to reverse polarity. In any of these cases, the magnets 658 of the mop pad 654 can be released or repelled by interrupting the supply of electrical current to the electromagnet 674, thereby releasing the mop pad 654 from the mop head 610.

In other embodiments, the electromagnet 674 of the mop head 610 is normally magnetized to attract the magnets 658 of the mop pad 654. In such embodiments, electrical current can be supplied to the electromagnet 674 via the battery 672 and lead wires 676 in order to reduce or eliminate the magnetic field generated by the electromagnet 674 sufficiently for the mop pad 654 to be removed (e.g., under gravitational force in some embodiments, or by user action in other embodiments). Alternatively, such electrical current can reverse the polarity of the magnetic field generated by the electromagnet 674, thereby repelling the mop pad 654 from the mop head 610. In either ease, the electrical current can be supplied via the user-manipulatable control 675.

The location of the user-manipulatable control 675 on the handle 616 provides added convenience to the user by providing a control for the actuator 698 (i.e., the electromagnet 674, lead wires 676, and battery 672) that is remote from the mop head 610. However, in other embodiments, the user-manipulatable control 675 is located on the mop head 610 for actuation by a user's hand or foot.

In some embodiments, the bottom surface of the mop head 610 includes protrusions to create a greater frictional engagement between the mop pad 654 and the mop head 610. These protrusions can have any of the forms described above in connection with the embodiments of FIGS. 1-10, and can help limit relative movement between the mop pad 654 and the mop head 610 during mopping or scrubbing. In some embodiments, the protrusions are shaped to only engage the mop pad 654 while the mop head 610 is moved forward and backward over a surface, so that protrusions generally do not grip the mop pad 654 while the mop head 610 is not in use.

As described above, the mop head 510 illustrated in FIGS. 11-13 has two rows of magnets 560 for attracting two rows of magnets 558 of a mop pad 554, whereas the mop head 610 illustrated in FIG. 14 has a single electromagnet 674 with a rectangular perimeter that can be magnetized by an electrical current to attract magnets 658 of the mop pad 654. In other embodiments, the mop head 510, 610 can be provided with any number, size, and shape of magnets or electromagnets for attraction to any number, size, and shape of magnets in a mop pad 554, 654. By way of example only, the magnets 560 of the mop head 510 shown in FIGS. 11-13 can be replaced by two strips of magnetic material on the two tubes 562. As another example, fewer or more magnets 560 can be located in the mop head 510 shown in FIGS. 11-13 based at least in part upon the number, size, and locations of the tubes 562 or other magnet-carrying elements of the mop head 510. As yet another example, the single electromagnet 674 of the mop head 610 shown in FIG. 14 can be replaced by any greater number of electromagnets 674 positioned in any manner across the mop head 610 to correspond to one or more magnets of any shape and size on the mop pad 654. Still other examples of magnet and electromagnet placements, sizes, and shapes are possible, and fall within the spirit and scope of the present invention.

FIGS. 15-20 illustrate alternate constructions of mop heads and actuation systems according to additional embodiments of the present invention. These embodiments employ much of the same structure and have many of the same properties as the embodiments of the mop head described above in connection with FIGS. 1-14. Accordingly, the following description focuses primarily upon the structure and features that are different than the embodiments described above in connection with FIGS. 1-14. Reference should be made to the description above in connection with FIGS. 1-14 for additional information regarding the structure and features, and possible alternatives to the structure and features of the mop heads illustrated in FIGS. 15-20 and described below. Structure and features of the elements shown in FIGS. 15-20 are designated hereinafter in respective 700 and 800 series of reference numbers.

Figure 15:
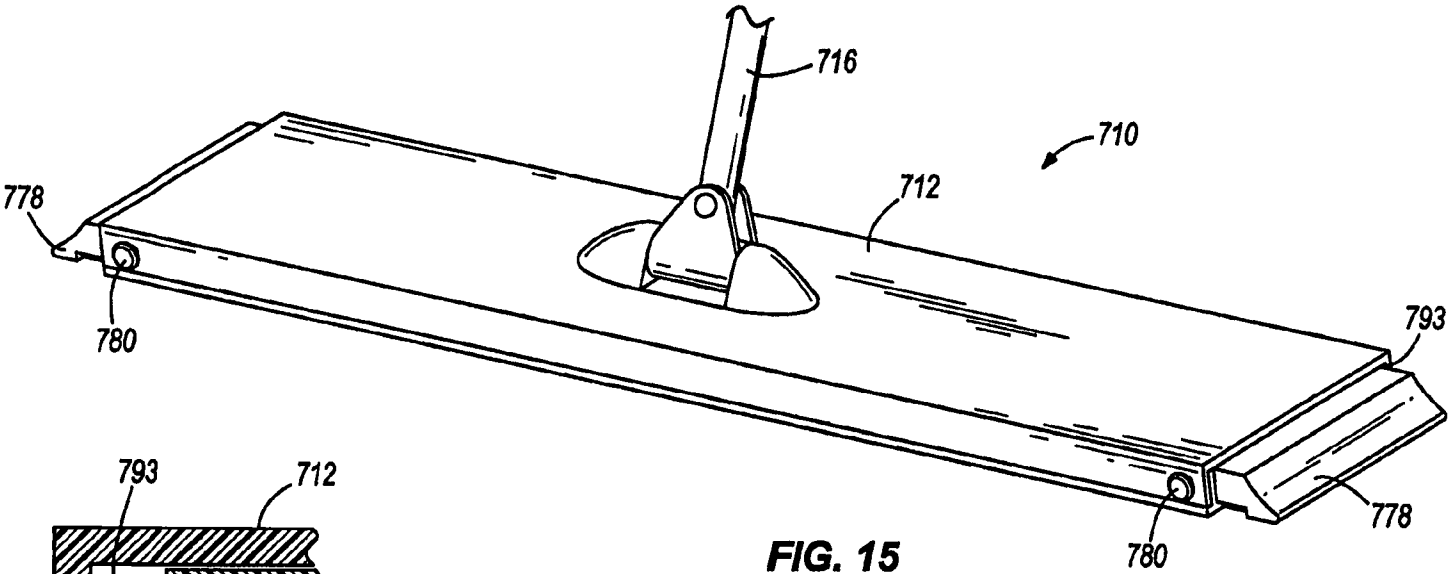
FIG. 15 is a perspective view of a mop head according to another embodiment of the present invention.
Figure 16:
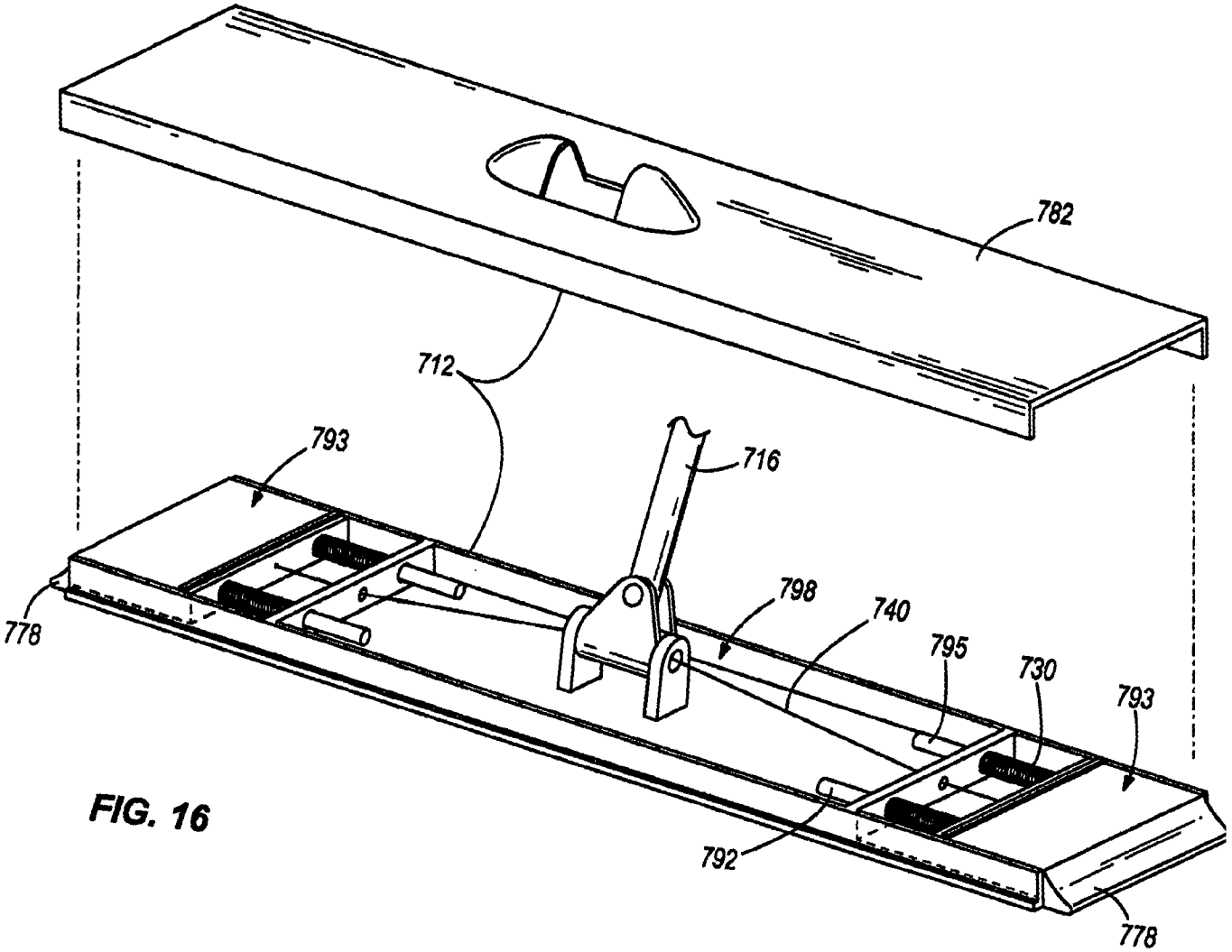
FIG. 16 is a partially exploded perspective view of the mop head illustrated in FIG. 15, shown with a pair of wings each in a retracted position.
Figure 17:
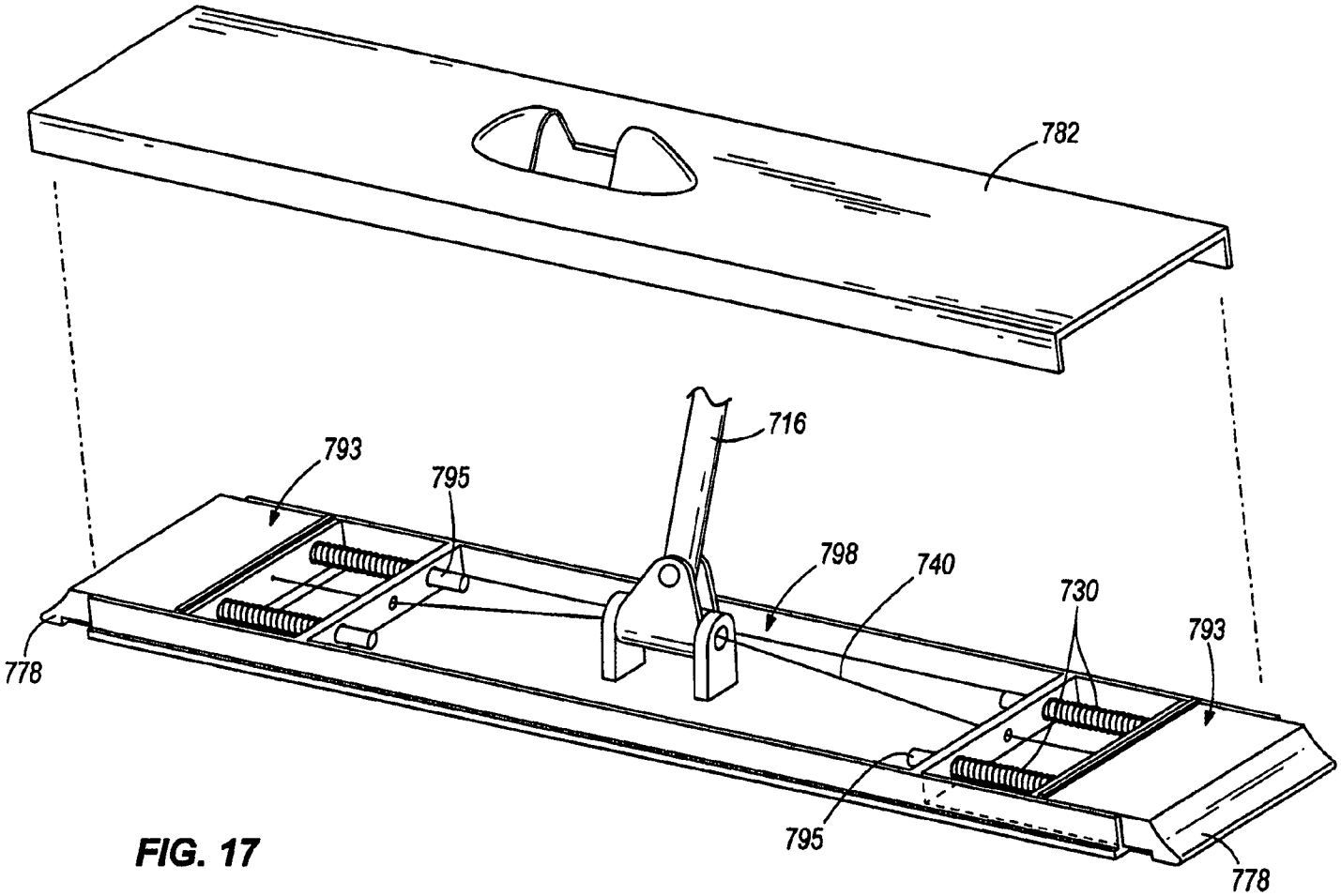
FIG. 17 is a partially exploded perspective view of the mop head illustrated in FIG. 15, shown with the pair of wings each in an extended position.

FIGS. 15-17 illustrate a mop head 710 having telescoping wings 778 used for releasable attachment of a mop pad (not shown) to the mop head 710. The telescoping wings 778 can be extended for insertion into pockets, straps, slots, or other elements on a mop pad, thereby securing the mop pad to the mop head 710. The telescoping wings 778 can also be retracted for removal from such mop pad elements, thereby releasing the mop pad from the mop head 710. In the illustrated embodiment of FIGS. 15-17, the mop head 710 includes two or more locking pins 780 (shown only in FIG. 15) for each wing 778 that maintain the wings 778 in the retracted positions, to allow an operator to attach the mop pad to the mop head 710 in a multi-step process. The operator retracts the wings 778, places the mop pad on the mop head 710 and releases the locking pins 780 to allow the wings 778 to be biased outwardly.

The telescoping wings 778 illustrated in FIGS. 15-17 each extend substantially the entire width (i.e., along substantially an entire lateral side) of the mop head 710, and are movable into and out of respective receptacles 793 defined in the body 712. In other embodiments however, the wings 778 can have different shapes and occupy different portions of the body 712. For example, either or both wings 778 can be tubular frames movable into and out of receptacles 793 in the body 712, bars, rods, or other elongated elements performing the same function, and the like. Any wing shape capable of performing the same or similar movement for insertion into and retraction from mop pad elements can be used.

The wings 778 can have any range of telescoping movement desired. This range of movement is determined in many cases by the shape, size, and position of the pockets or other elements of the mop pad into which the wings 778 are received.

Although the mop head 710 in the illustrated embodiment of FIGS. 15-17 has two wings 778 movable in telescoping relationship with the mop head body 712 in generally lateral directions, it should be noted that the wings 778 can instead be positioned and oriented with respect to the mop head body 712 to extend and retract in any other direction desired, including without limitation in forward and rearward directions, in directions between lateral and forward/rearward directions, and the like. In each case, the wings 778 can still perform the function of extending into and retracting from mop pad pockets or other mop pad elements to releasably connect the mop pad to the mop head, depending at least in part upon the positions and orientations of such mop pad pockets or other mop pad elements.

The mop head 710 illustrated in FIGS. 15-17 has two wings extendable in opposite lateral directions. However, in other embodiments, the mop head 710 can have any number (e.g., one, three, four, and the like) of wings 778 extendable in any number of directions. By way of example only, the mop head 710 can have a single wing 778 extendable and retractable for insertion into and removal from a mop pad pocket or other element, in which case other portions of the mop pad can be pulled taut against a peripheral edge of the mop head 710 opposite the wing 778 or can be releasably attached to the mop head 710 in any other manner. As another example, the mop head 710 can have four wings 778 extendable and retractable with respect to each side of a rectangular mop head 710, or other numbers of wings 778 for each side of mop heads 710 having different shapes.

With continued reference to the illustrated embodiment of FIGS. 15-17, the illustrated wings 778 are each biased in an outward (i.e., extended) direction with respect to the mop head body 712. This wing biasing feature can be performed in any of the manners described herein for biasing mop head elements, including those described above in connection with grips in the embodiments of FIGS. 1-10. With particular reference to FIGS. 16 and 17, each wing 778 in the illustrated embodiment is biased by two coil springs 730 located between the wing 778 and an internal wall of the mop head body 712. In other embodiments, any other number of springs of any other type (including those described above with reference to the illustrated embodiment of FIGS. 1-3) can be directly or indirectly connected to the wings 778 for performing the same function. The springs 730 shown in FIGS. 16 and 17 are received upon rods 795 of the wings 778, which telescope with respect to apertured walls of the mop head body 712 to help control and stabilize movement of the wings 778. However, in other embodiments, the springs 730 can be located in any other suitable position(s) to bias the wings 778 as just described. Although the wings 778 illustrated in FIGS. 15-17 are each biased in an extended direction, it will be appreciated that either or both wings 778 can be biased in a retracted direction in other embodiments.

As best shown in FIGS. 16 and 17, the wings 778 in the illustrated embodiment are each movable by an actuator 798 defined at least in part by a set of cables 740 extending to each wing 778 and also extending toward the mop handle 716. By pulling upon the cables 740, force is transmitted to the wings 778 to retract the wings 778 against the biasing force of the springs 730. In the illustrated embodiment of FIGS. 15-17, two cables 740 (one per wing 778) extend from the wings 778 to the mop handle 716. These cables 740 can be connected to a single cable (not shown) extending upward along the inside of the mop handle 716 to a user-manipulatable control (not shown, but illustrated and described in greater detail below), can all extend to the user-manipulatable control, or can be indirectly attached thereto in any other manner.

As described above with reference to earlier illustrated embodiments, the cables 740 can take the form of cables capable of exerting pushing and pulling forces (e.g., Bowden cables), in which cases biasing members 730 need not necessarily be used. Also, by re-routing the cables about appropriately-positioned walls, pins, rollers, and other elements, the cables 740 can be oriented to pull the wings 778 to their extended positions and/or to push the wings 778 to their retracted positions. In some embodiments, the cables 740 are replaced by linkages (e.g., pinned or otherwise articulated links) extending to the user-manipulatable control on the mop head handle 716 and capable of exerting extending and/or retracting force upon the wings 778. Furthermore, any of the cam elements described herein (including those described above in connection with FIGS. 1-3, 6, and 7) and any of the other actuators described herein (including the twist-type actuator described above in connection with FIGS. 8-10) can be utilized to extend and/or retract the wings 778.

The use of the cable actuator or other actuators described herein in order to retract and/or extend the wings 778 can provide a significant advantage to users by eliminating the need to touch or grasp a mop pad for attachment to and/or removal from the mop head 710. Particularly when used in conjunction with a user-manipulatable control on the mop handle 716 and remote from the mop head 710, this actuator 798 can provide a quick and simple manner in which to perform an otherwise tedious or messy task.

In some embodiments, it is desirable to retain either or both wings 778 in a retracted and/or extended position. Although in some embodiments this is possible by retaining a force upon the wings 778 through the actuator 798 (such as by retaining or locking the user-manipulatable control in a particular position), in some embodiments this capability is provided by one or more locks on the mop head 710. Such a mechanism is shown in FIGS. 15 and 15A by way of example only, and can be used to retain the wings 778 in extended positions, retracted positions, or in extended and retracted positions, and whether against force of biasing members 730 or otherwise.

Figure 15A:
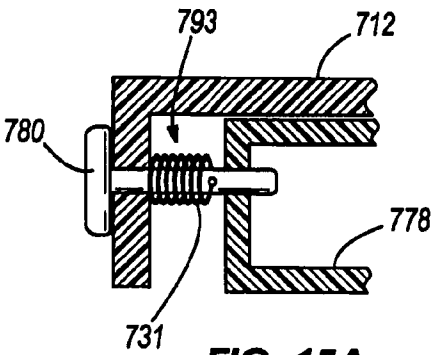
FIG. 15A is a partial, cross-section view of the locking pin arrangement of FIG. 15.

With continued reference to FIGS. 15 and 15A, each wing 778 has at least one locking pin 780, each of which extends through a respective aperture in the mop head body 712 and into an aperture in one of the wings 778. In such positions, the retractable locking pins 780 can be used to secure the wings 778 in retracted positions while a user positions the mop head 710 with respect to a mop pad during mop pad installation. The locking pins 780 can be located on sides of the mop head body 712 as shown in FIG. 15 to provide convenient user access thereto in order to release the wings 778, or can instead be located in other positions atop, beneath, or on any side of the mop head body 712. In some embodiments, the locking pins 780 can be biased into or away from their wing-locking positions. For example, in the illustrated embodiment, each of the locking pins 780 is provided with a biasing member 731 (e.g., a coil spring or any other type of biasing member described herein) positioned to exert a force causing insertion of the locking pin 780 into a corresponding aperture of the wing 778. Other arrangements and constructions of biasing members can instead be used in addition to or in place of the illustrated biasing members 731.

In some embodiments, the user-manipulatable control (described and illustrated below) on the handle 716 includes first, second and third positions, while the actuator 798 is operably coupled to the wings 778 and the locking pins 780. In moving the user-manipulatable control in a first manner, the actuator 798 pulls or pushes upon the wings 778 to extend or retract the wings 778 and to eventually cause engagement of the locking pins 780. In moving the user-manipulatable control again in the same manner or in a different manner, the actuator 798 causes disengagement of the locking pins 780 and retraction or extension of the wings 778.

Figure 18:
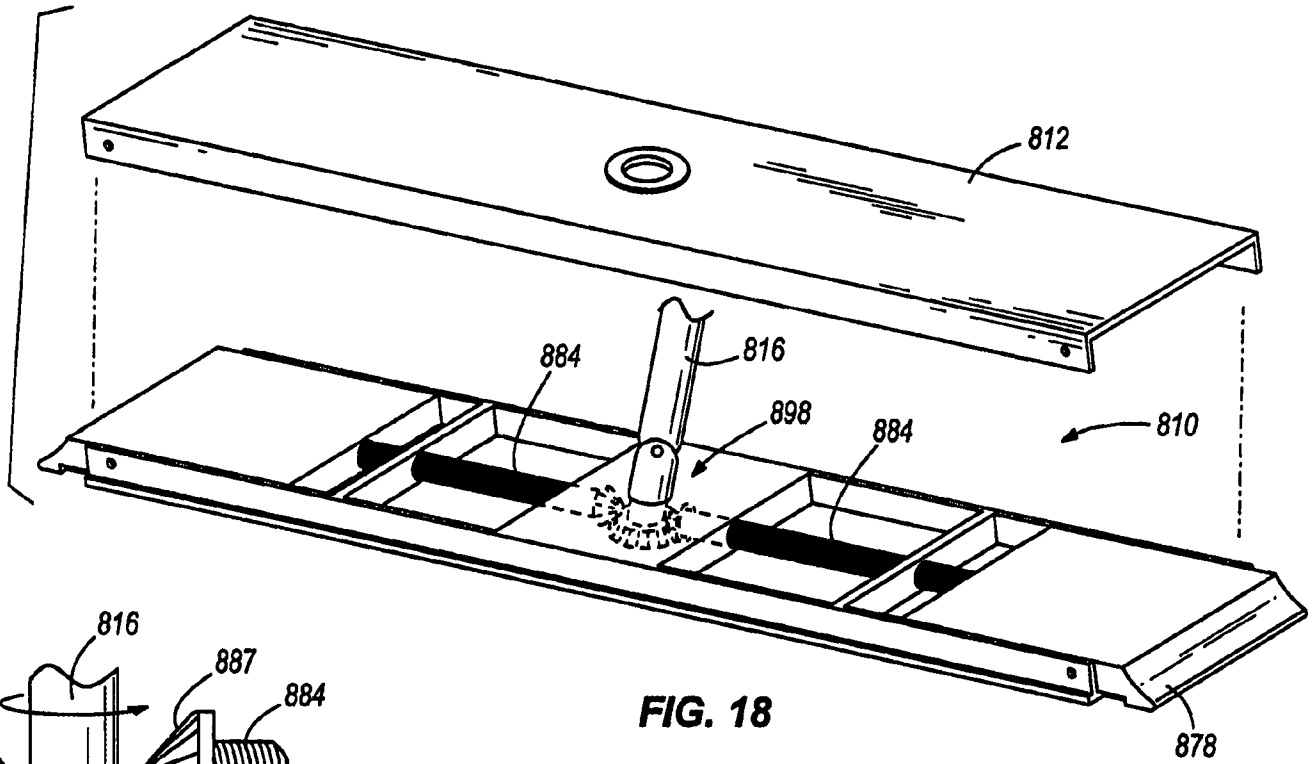
FIG. 18 is a perspective view of a mop head according to another embodiment of the present invention.
Figure 18A:
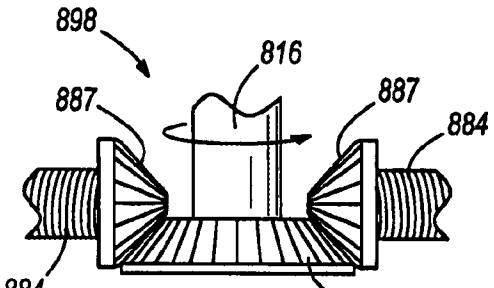
FIG. 18A is a detail view of a portion of the actuator shown in FIG. 18.
Figure 19:
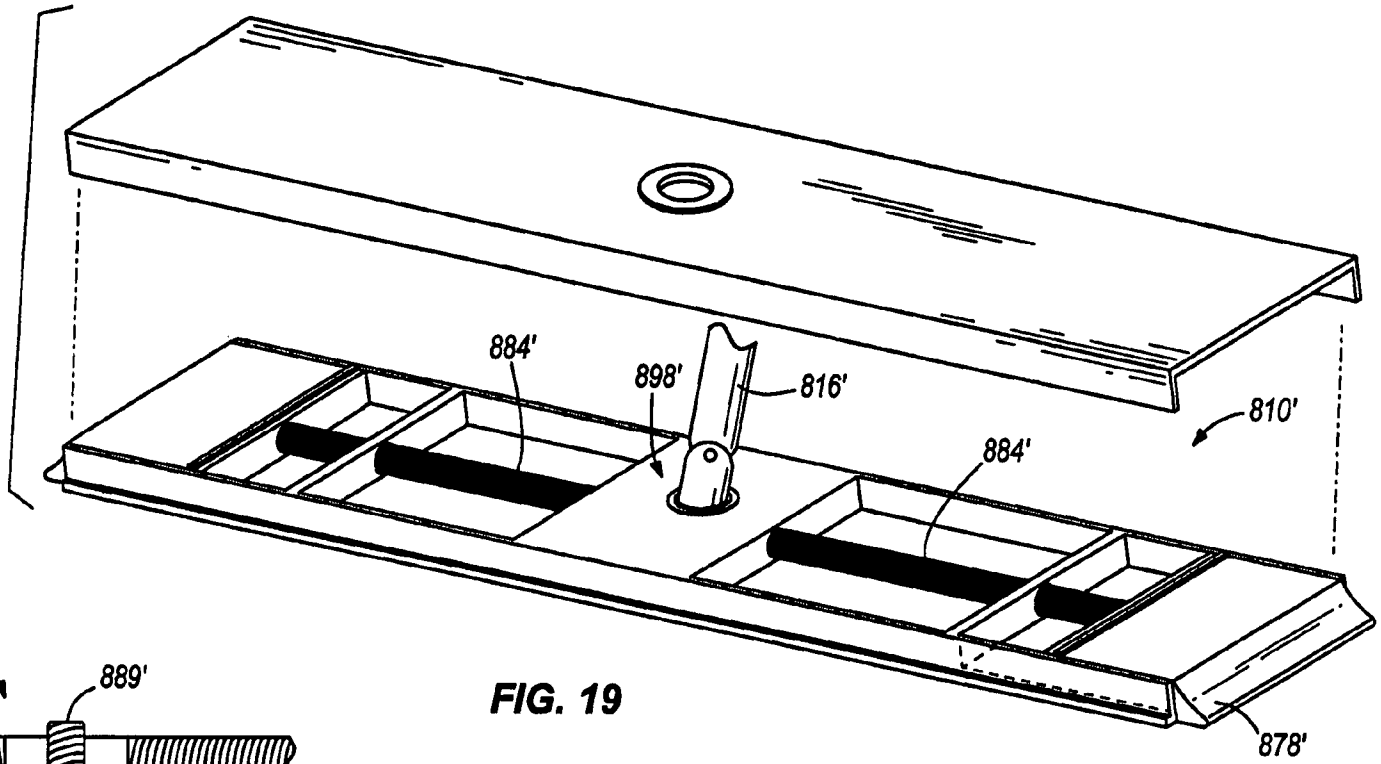
FIG. 19 is a partially exploded perspective view of a mop head according to another embodiment of the present invention, shown with a pair of wings each in a retracted position.
Figure 19A:
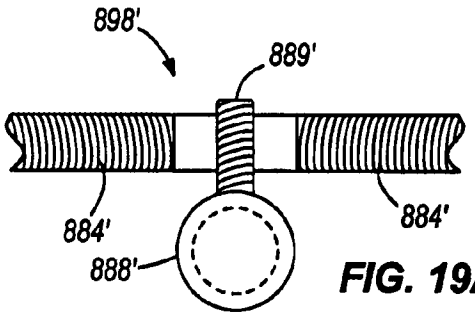
FIG. 19A is a detail view of a portion of the actuator shown in FIG. 19.
Figure 20:
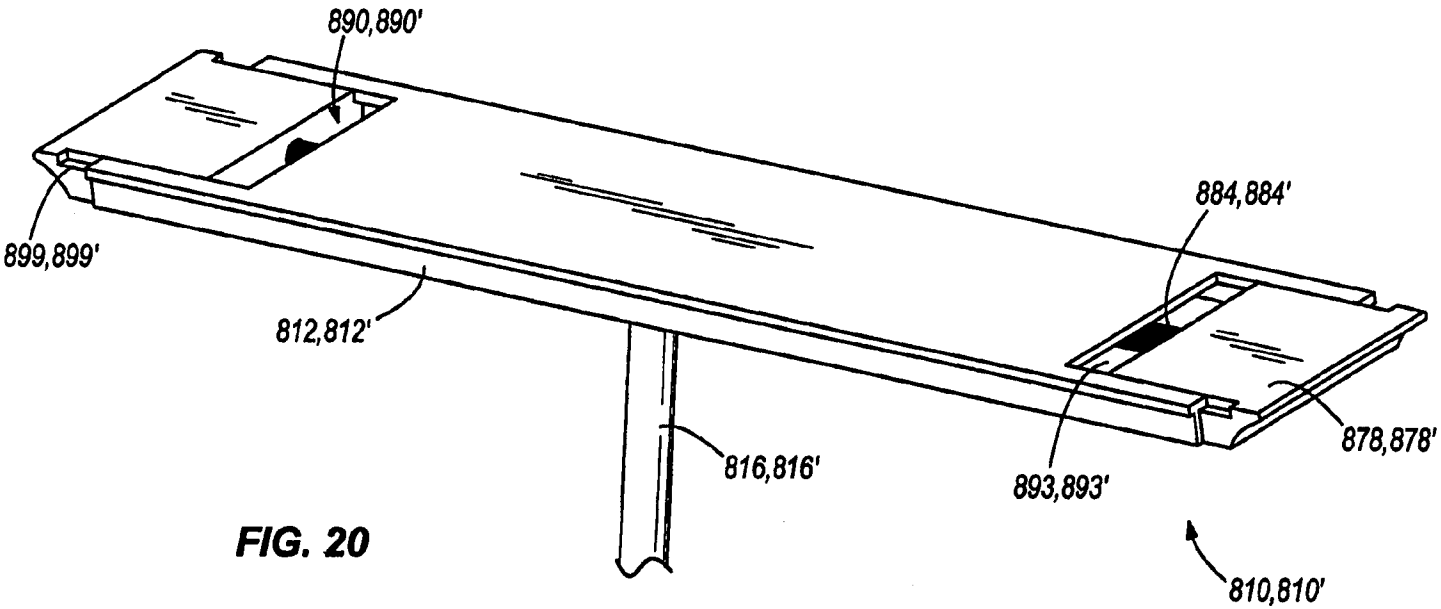
FIG. 20 is a bottom perspective view of the mop head illustrated in FIG. 19, shown with the pair of wings each in an extended position.

The mop heads 810, 810' illustrated in FIGS. 18-20 are similar in many respects to that described above and illustrated in FIGS. 15-17, with the exception of the actuator used to move the wings 878, 878'. Accordingly, reference is hereby made to the description above in connection with FIGS. 15-17 for more information regarding the features, elements, and alternatives to the features and elements of the embodiments described below in connection with FIGS. 18-20.

In the illustrated embodiments of FIGS. 18-20, FIGS. 18 and 20 show the wings 878, 878' of the mop head 810, 810' in an extended position, while FIG. 19 shows the wings 878' in a retracted position. FIG. 20 shows the same features and elements for both embodiments illustrated in FIGS. 18 and 19, and so therefore has reference numbers corresponding to both embodiments of FIGS. 18 and 19. Like the embodiment of FIGS. 15-17, locking pins 880 (shown only in FIG. 18) can be provided for releasably securing the wings 878, 878' in retracted and/or extended positions as described in greater detail above.

The mop head 810 of FIGS. 18 and 20 has an actuator 898 operable to move the wings 878 to extended and retracted positions. The actuator 898 includes a threaded shaft 884 mechanically connecting each wing 878 to a bevel gear 886 connected to the mop handle 816. Each threaded shaft 884 is connected to a respective bevel gear 887 engaged with the bevel gear 886 driven by the mop handle 816, and is threaded into a threaded aperture of a respective wing 878. With this construction, the handle 816 can be twisted to drive the threaded shafts 884 with the bevel gears 887, 886, thereby threading the wings 878 toward extended or retracted positions. As noted above, the mop head 810 can have any number of wings 878, in which case each wing 878 can be provided with a respective threaded shaft 884 and bevel gear 887 for being driven by the bevel gear 886 and handle 816 as just described.

Although the actuator 898 in the mop head 810 illustrated in FIGS. 18 and 20 utilizes a set of bevel gears to transmit twisting motion of the mop handle 816 to extending and retracting motion of the wings 878, it will be appreciated that the actuator 898 can be defined by a number of other types of gears and driving mechanisms performing the same function. For example, the mop head 810' illustrated in FIGS. 19 and 20 has an actuator 898' that includes a helical gear 888' connected to a lower portion of the handle 816' and engaged with another helical gear 889' on a threaded shaft 884' extending to both illustrated wings 878'. The opposite ends of the threaded shaft 884' (with left-handed threads and right-handed threads, respectively) can be threaded into threaded apertures in the wings 878' so that as the threaded shaft 884' rotates in a first direction, the wings 878' extend, and as the threaded shaft 884' rotates in a second opposite direction, the wings 878' retract. Still other mechanical driving mechanisms can be utilized to transmit twisting force from the handle 816, 816' to extending and retracting force upon the wings 878, 878', all of which fall within the spirit and scope of the present invention. In these cases, the actuator 898, 898' can again provide a convenient manner in which a user can remotely remove and/or replace a mop pad without touching or grasping the mop pad.

FIG. 20 illustrates an underside view of both mop heads 810, 810' shown in FIGS. 18 and 19, and provides an example of how the wings 878', 878' can be shaped and positioned with respect to the mop head body 812, 812' so that the underside of the mop head 810, 810' defines a substantially flat or planar surface to evenly engage a flat surface during use. The wings 878, 878' shown in FIG. 20 are nested within their respective receptacles 893, 893', and are also retained within the mop head body 812, 812' by a slidable engagement between the wings 878, 878' and adjacent portions of the mop head body 812, 812'. More specifically, opposite edges 899, 899' of each wing 878, 878' can be stepped as shown or can otherwise be shaped to inter-engage with adjacent surfaces of the mop head body 812, 812'. Other types of inter-engaging features of the wings 878, 878' and mop head body 812, 812' include one or more pins, ledges, or other protrusions of the wings 878, 878' or mop head body 812, 812' slidably received within one or more grooves, slots, or other apertures in the mop head body 812, 812' or wings 878, 878', respectively. In all such cases, the wings 878, 878' can be shaped to have a bottom surface substantially co-planar to the bottom surface of the mop head body 812, 812' as described above. It should also be noted that the type of wing-to-mop head body inter-engagement shown in FIG. 20 is also utilized by way of example in the embodiment of FIGS. 15-17.

Figure 21:
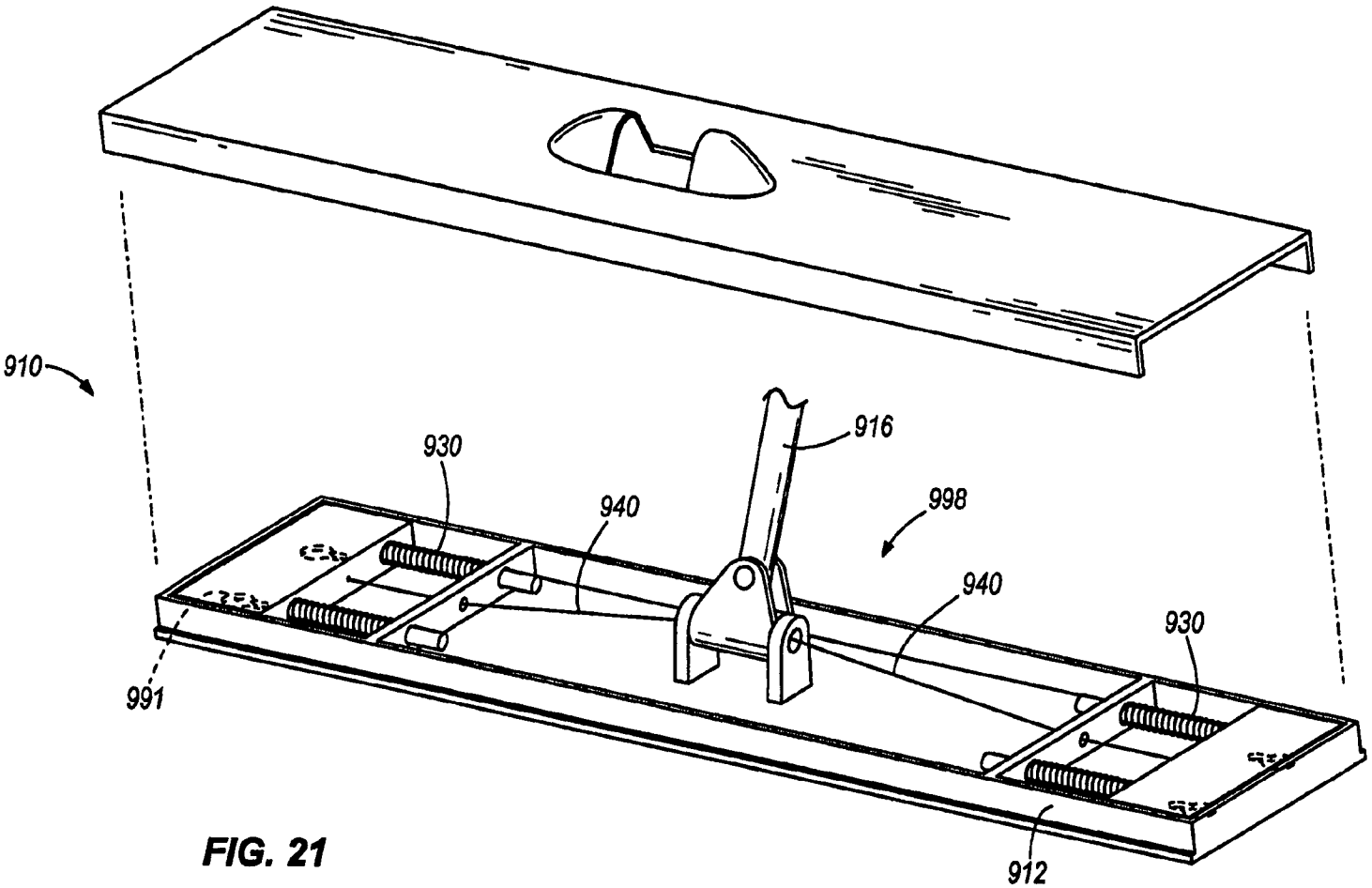
FIG. 21 is a partially exploded perspective view of a mop head according to another embodiment of the present invention.
Figure 22:
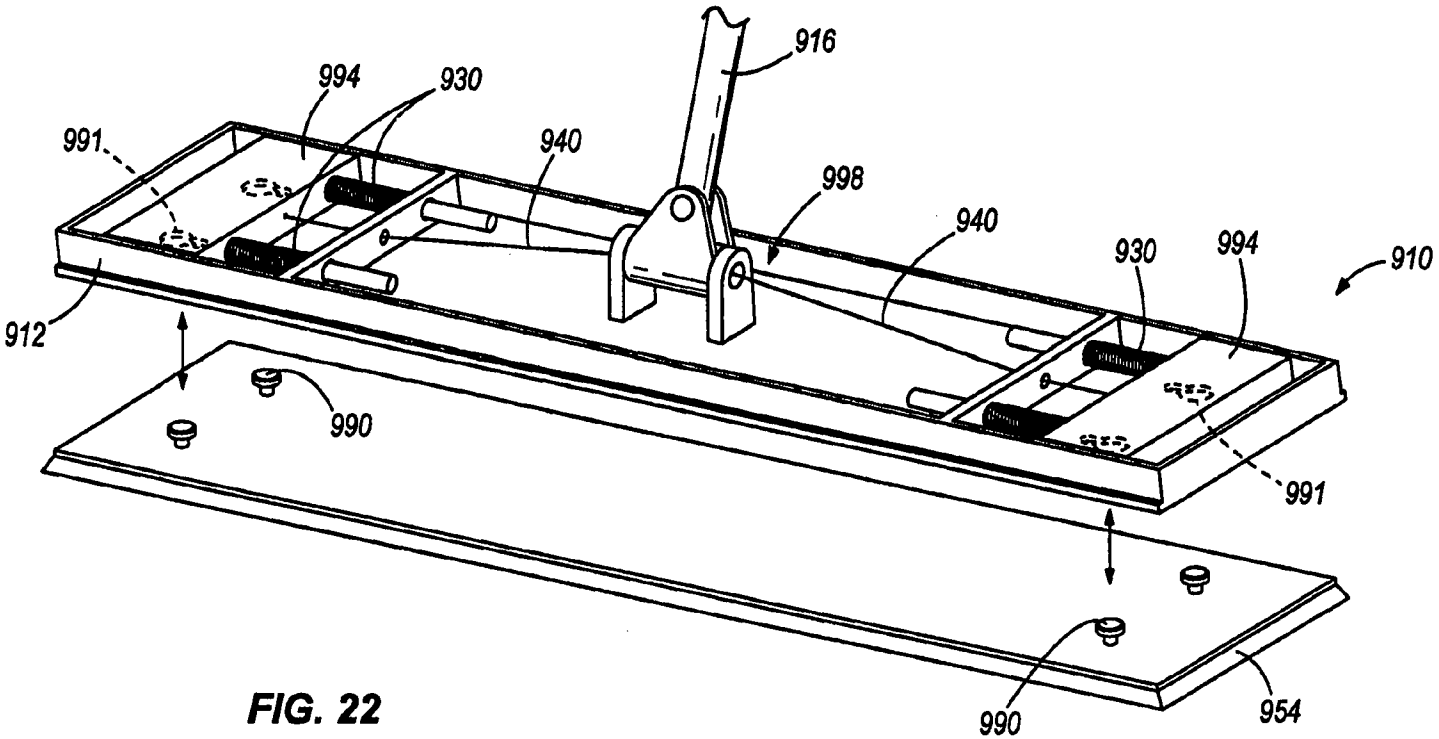
FIG. 22 is a perspective view of a portion of the mop head illustrated in FIG. 21, shown ready for connection with a mop pad.
Figure 23:
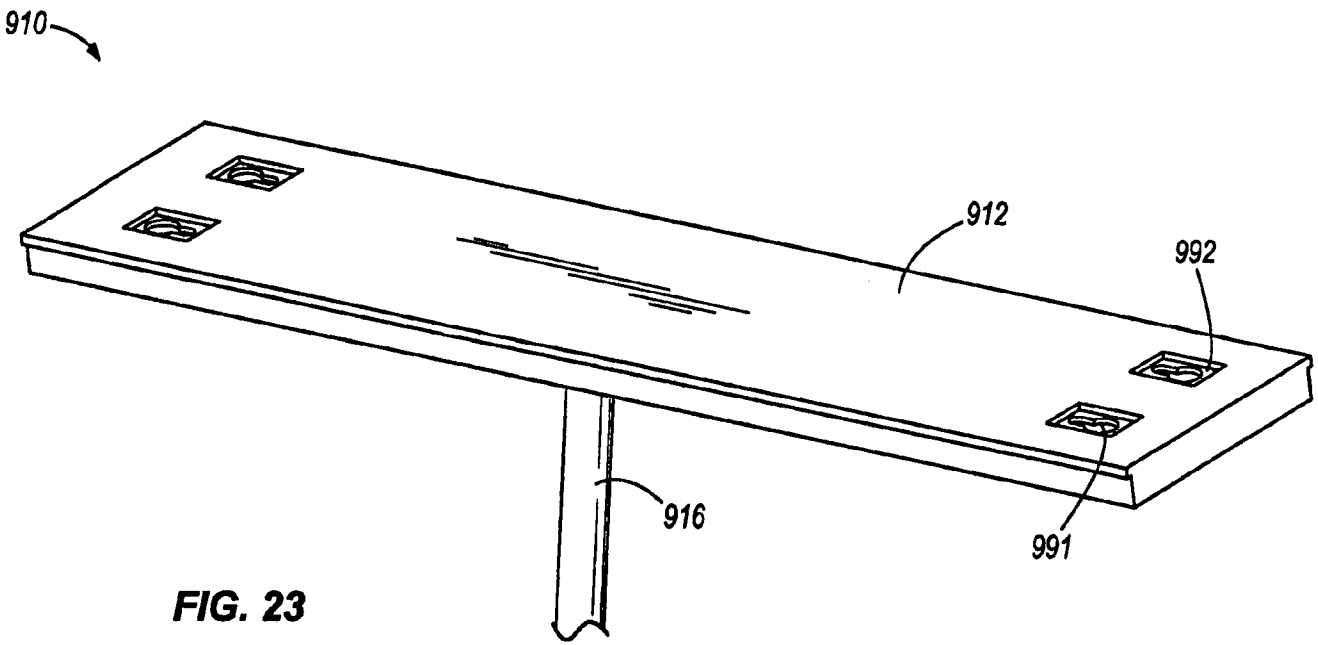
FIG. 23 is a bottom perspective view of the mop head shown in FIG. 21.

FIGS. 21-23 illustrate an alternate construction of a mop head and actuator according to an additional embodiment of the present invention. This embodiment employs much of the same structure and has many of the same properties as the embodiments of the mop head described above in connection with FIGS. 1-20. Accordingly, the following description focuses primarily upon the structure and features that are different than the embodiments described above in connection with FIGS. 1-20. Reference should be made to the description above in connection with FIGS. 1-20 for additional information regarding the structure and features, and possible alternatives to the structure and features of the mop head illustrated in FIGS. 21-23 and described below. Structure and features of the elements shown in FIGS. 21-23 are designated hereinafter in the 900 series of reference numbers.

The mop head 910 illustrated in FIGS. 21-23 relies at least in part upon releasable engagement between protrusions 990 on a mop pad 954 and apertures 992 in the mop head 910 to releasably secure the mop pad 954 to the mop head 910. As best shown in FIG. 23, the body 912 of the mop head 910 has apertures 992 defined therein for receiving headed protrusions 990 extending from the mop pad 954. The apertures 992 can have any shape and size capable of receiving the protrusions 990, and in the illustrated embodiment are square by way of example only. Four protrusions 990 and four corresponding apertures 992 in a generally rectangular arrangement (proximate the four corners of the mop head body 912 and mop pad 954) are used in the embodiment of FIGS. 21-23. However, in other embodiments, any fewer or greater number of protrusions 990 and apertures 992 can instead be used, and can be located in any positions on the mop head body 912 and mop pad 954.

The mop head 910 shown in FIGS. 21-23 has a pair of slides 994 movable with respect to the mop head body 912. The slides 994 each have apertures 991 dimensioned to receive the protrusions 990 of the mop pad 954. By movement of the slides 994 in a manner described in greater detail below, the apertures 991 of the slides 994 can be moved into and out of positions with respect to the apertures 992 of the mop head body 912 to receive the protrusions 990 of the mop pad 954. When each slide 994 is in at least one position, the apertures 991 of the slide 994 are aligned or substantially aligned with the protrusions 990 to permit passage of the protrusions 990 into and out of the apertures 991. When the slide 994 is in at least one other position, the apertures 991 of the slide 994 are positioned to prevent such passage while still retaining the protrusions 990 within the apertures 991. This relationship between the apertures 991 and the protrusions 990 is facilitated by the shape of the apertures 991. In the illustrated embodiment of FIGS. 21-23, for example, each aperture 991 is keyhole shaped, thereby enabling the protrusions 990 to pass therethrough when the large portion of aperture 991 is aligned or substantially aligned with a corresponding protrusion 990 of the mop pad 954, and blocking withdrawal of the protrusion 990 when the small portion of the aperture 991 is aligned or substantially aligned with the protrusion 990.

It will be appreciated that other aperture shapes can perform the same or similar function, including without apertures 991 that are wedge-shaped, hook-shaped, irregular, or that have still other shapes. Also, in some embodiments one or more of the protrusions 990 can be trapped between an edge of the aperture 991 and an edge of a corresponding aperture 992 in the mop head body 912 when the slide 994 is moved with respect to the mop head body 912. In such embodiments, additional shapes of the apertures 991 can be used for releasably retaining the protrusions 990.

The slides 994 in which the apertures 991 are defined can have any shape and size capable of defining the apertures 991, and in the illustrated embodiment are generally rectangular. Each slide 994 can be moved to its different positions using any of the actuators described herein, including those described above for moving the grips or wings of mop heads. By way of example only, the slides 994 shown in FIGS. 21 and 22 are moved by an actuator 998 that is the same as the actuator used in the embodiment of FIGS. 15-17 (defined at least in part by cables 940). Accordingly, and as described in greater detail above in connection with FIGS. 15-17, cables 940 connected to a remote user-manipulatable control (not shown, but illustrated and described below) on the mop handle 916 are connected to each slide 994, and can be pulled against biasing force from springs 930 to move the slide 930. In so doing, the apertures 991 of each slide 994 can be moved by the user to secure or release the protrusions 990 within the apertures 991. In the illustrated embodiment of FIGS. 15-17, the cables 940, springs 930, and slides 994 are positioned so that when the cables 940 are pulled by a user, the slides 994 move to align the mop pad protrusions 990 with the larger portions of each aperture 991, thereby permitting a user to install or detach the mop pad 954 from the mop head 910. By releasing the pulling force, the springs 930 urge the slides 994 to positions in which mop pad protrusions 990 in the apertures 991 are trapped within the smaller portions of the apertures 991, thereby retaining the mop pad 954 on the mop head 910.

It will be appreciated that the apertures 991 can be re-oriented, and the cables 940 and springs 930 can be re-positioned so that the slides 994 move in any other direction to trap the mop pad protrusions 990 within the apertures 991. In this regard, any number of slides 994 moveable in any direction (e.g., forward and rearward, diagonally with respect to lateral and forward-rearward directions of the mop head 910, and the like) can be used to releasably secure the mop pad 954 to the mop head 910 in the manner just described.

The protrusions 990 shown in FIG. 22 are posts with enlarged heads. However, in other embodiments, the protrusions 990 can have other shapes capable of engagement and retention by the slides 994 in a manner similar to that described above. For example, the protrusions can be hook-shaped, can be posts inclined with respect to the mop pad 954, can be walls, bosses, brackets, or other elements shaped to have a portion trapped by the slides 994 when actuated as described above, and the like, all of which fall within the spirit and scope of the present invention. Accordingly, the apertures 991 in which these alternate protrusions 990 are removably received and trapped can have any shapes (in addition to the keyhole shapes shown in FIGS. 21-23) adapted to receive these alternate protrusions.

As described above, the mop pad 954 illustrated in FIG. 22 has protrusions 990 that can be removably received and trapped within apertures 991 in the slides 994 of the mop head 910. In other embodiments, the locations of any or all of these protrusion and aperture sets can be reversed. For example, in some embodiments, either or both slides 994 can have protrusions that extend into apertures in the mop pad 954. Such protrusions and apertures can have any of the shapes described above. Upon actuation of the slides 994 as also described above, the protrusions can therefore move within the apertures to positions in which the protrusions are locked in the apertures. Similarly, actuation of the slides 994 in an opposite direction moves the protrusions to positions within the apertures in which the protrusions can be removed from the apertures.

The mop head 910 illustrated in FIGS. 21-23 has two slides 994 located at opposite lateral ends of the mop head 910. However, in other embodiments, any number of slides 994 positioned anywhere in the mop head 910 can instead be used while still performing the same releasable engagement function described above. In many cases, and depending at least in part upon the type of actuator used to move the slides 994, the mop head 910 need not necessarily utilize biasing members to bias the slides 994.

FIGS. 24-27 illustrate alternate constructions of mop head actuators and mop pads according to additional embodiments of the present invention. These embodiments employ much of the same structure and have many of the same properties as embodiments of the mop head described above in connection with FIGS. 1-23. Accordingly, the following description focuses primarily upon the structure and features that are different than the embodiments described above in connection with FIGS. 1-23. Reference should be made to the description above in connection with FIGS. 1-23 for additional information regarding the structure and features, and possible alternatives to the structure and features of the mop head actuators and mop pads illustrated in FIGS. 24-27 and described below. Structure and features of the elements shown in FIGS. 24-27 are designated hereinafter in respective hundreds series of reference numbers, starting with values in the 1000 series. It should be noted that the actuators 1098, 1098', 1198, 1298 shown in FIGS. 24-27 can be used to move any of the grips, wings, and slides in any of the mop head embodiments described herein.

Figure 24:
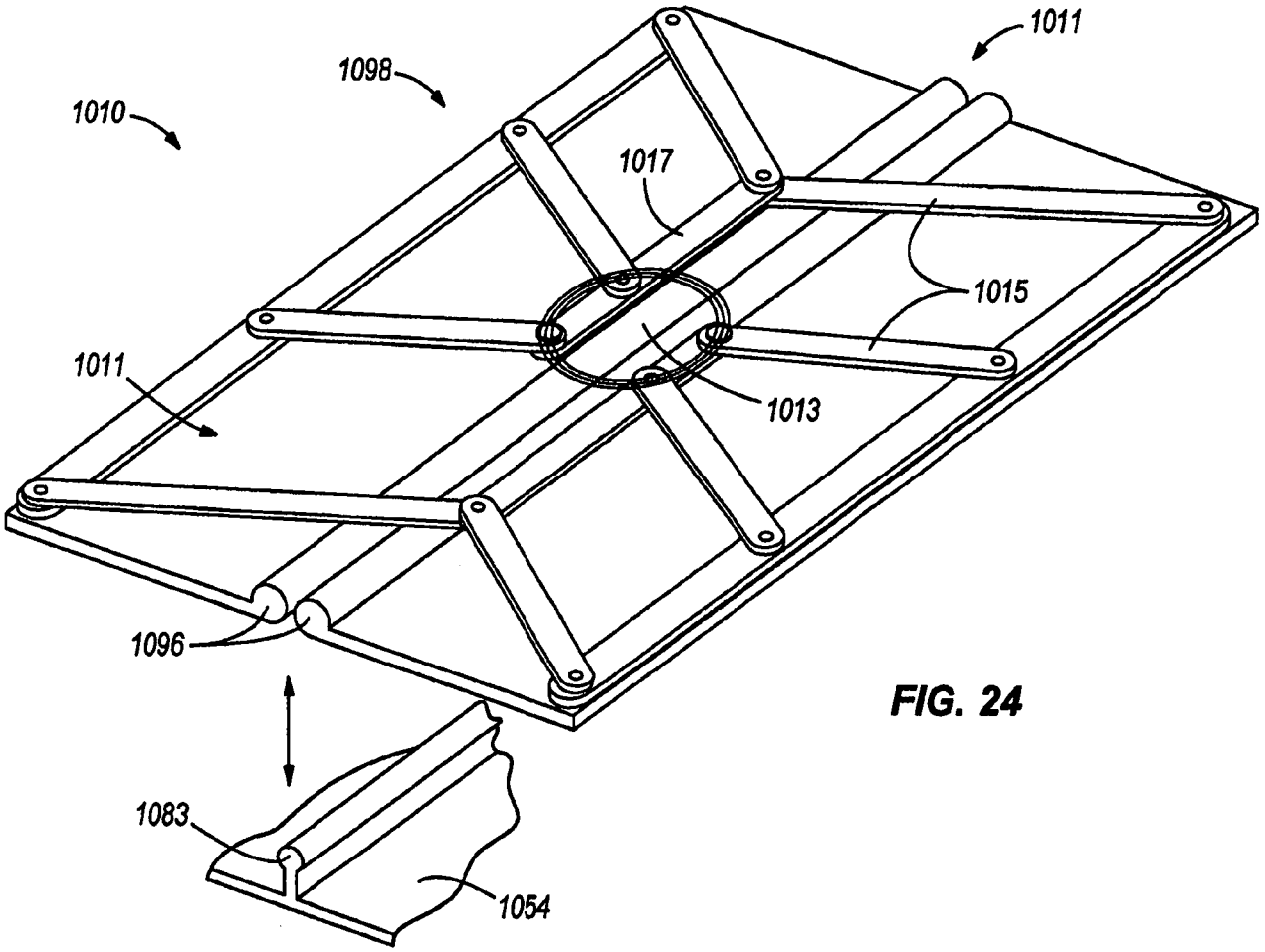
FIG. 24 is a perspective view of an actuator for a mop head according to another embodiment of the present invention, shown ready for connection with a mop pad.
Figure 25:
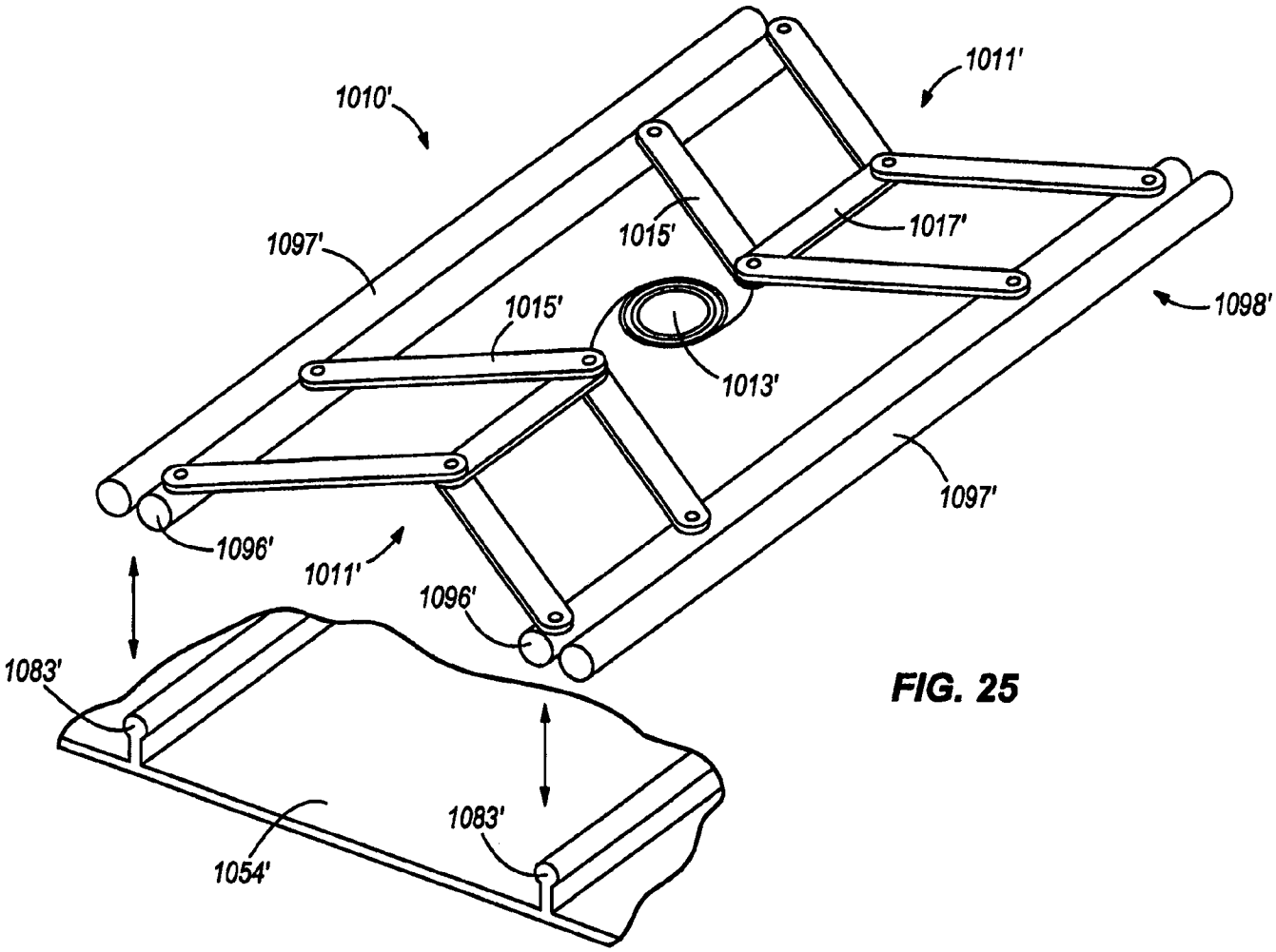
FIG. 25 is perspective view of an actuator for a mop head according to another embodiment of the present invention, shown ready for connection with a mop pad.

With reference first to FIGS. 24 and 25, each actuator 1098, 1098' illustrated therein utilizes clamping members (e.g., bars 1096, 1096', 1097') to clamp one or more edges or projections of the mop pad 1054, 1054'. In the illustrated embodiments, the projections are ribs 1083, 1083' that extend upwardly from the mop pad 1054, 1054'. The ribs 1083, 1083' also extend laterally along the mop pad 1054, 1054'. In some embodiments, such as those shown in FIGS. 24 and 25, the ribs 1083, 1083' extend substantially the entire length of the mop pad 1054, 1054'. Alternatively, the ribs 1083, 1083' can extend less than the entire length of the mop pad 1054, 1054'. In other embodiments, other types of projections can be used, such as one or more posts, bosses, brackets, or other features protruding from the mop pad 1054, 1054'.

In the embodiment of FIG. 24, the actuator 1098 has two clamping bars 1096 for clamping a rib 1083 on the mop pad 1054. The clamping bars 1096 are connected to a pair of four bar linkages 1011, one located on each lateral side of the actuator 1098. Each four-bar linkage 1011 is defined by links 1015, 1017 and by a clamping bar 1096 as shown in FIG. 24. The four bar linkages 1011 provide movement of the clamping bars 1096 toward and away From one another to generate releasable clamping action upon the rib 1083. In other embodiments, a single four-bar linkage or three or more four-bar linkages can instead be used for this purpose. Also, it will be appreciated that additional links (rather than the clamping bars 1096) can partially define either or both four bar linkages 1011.

With continued reference to FIG. 24, both four bar linkages 1011 are connected to a biasing member (e.g., torsion spring 1013) providing a biasing force upon the four bar linkages 1011. This biasing force exerts a torsional force drawing the clamping bars 1096 together, thereby normally clamping the rib 1083 between the clamping bars 1096 and securing the mop pad 1054 to the mop head 1010. Any of the links in either or both four-bar linkages 1011 can be turned by one or more cables, cams, gears, or other devices (described in greater detail above) connected to the mop handle (not shown), thereby countering the spring force exerted upon the four-bar linkages 1011 in order to spread the clamping bars 1096 apart and to release the rib 1083 and mop pad 1054.

The actuator 1098 illustrated in FIG. 24 has two clamping bars 1096, both of which are movable by user actuation. In other embodiments, any other number of clamping bars 1096 can instead be used for clamping any number of protrusions or edges of the mop pad 1054. For example, the actuator 1098' illustrated in FIG. 25 is adapted to releasably clamp two ribs 1083' of a mop pad 1054', and utilizes two movable clamping bars 1096' and two stationary clamping bars 1097' to do so. In this regard, two four-bar linkages 1011' are again used (although the alternatives described above with regard to the embodiment of FIG. 24 apply equally to the embodiment of FIG. 25), and cooperate with clamping bars 1097' mounted to or defined by portions of a mop housing (not shown) to clamp the mop pad 1054'. By biasing the four-bar linkages 1011' in any of the manners described above in connection with the embodiment of FIG. 24, the mop pad 1054' can be secured in multiple locations on a mop head. Also, the four-bar linkages 1011' can be actuated to open the clamping bars 1096', 1097' in any of the manners also described above in connection with the embodiment of FIG. 24.

In any of the embodiments described above in connection with FIGS. 24 and 25, the positions and orientations of the clamping bars 1096, 1096', 1097' can be changed in any manner desired to clamp any number of protrusions of the mop pad 1054, 1054' positioned and located in any other manner. For example, the clamping bars 1096, 1096', 1097' can extend in forward and rearward directions with respect to the mop head, and can be located at either or both lateral edges of the mop head or in any position therebetween for clamping similarly positioned and oriented protrusions of a mop pad. As another example, pairs of clamping bars 1096, 1096', 1097' located proximate each edge of a mop head can be used to releasably secure a mop pad having mating protrusions on all sides, in which cases additional four-bar linkages can be used to actuate the clamping bars 1096, 1096'. Still other positions and orientations of the clamping bars 1096, 1096', 1097' adapted to releasably clamp any number of protrusions on the mop pad are possible, and fall within the spirit and scope of the present invention.

In both of the embodiments illustrated in FIGS. 24 and 25, torsional force can be applied from a mop handle (not shown) connected to the torsion spring 1013, 1013' and/or to any of the linkages 1015, 1017, 1015', 1017' in order to move the clamping bars 1096, 1096' apart. This force can be transmitted in such manner using any of the mechanisms described above with respect to other embodiments of the present invention.

Figure 26:
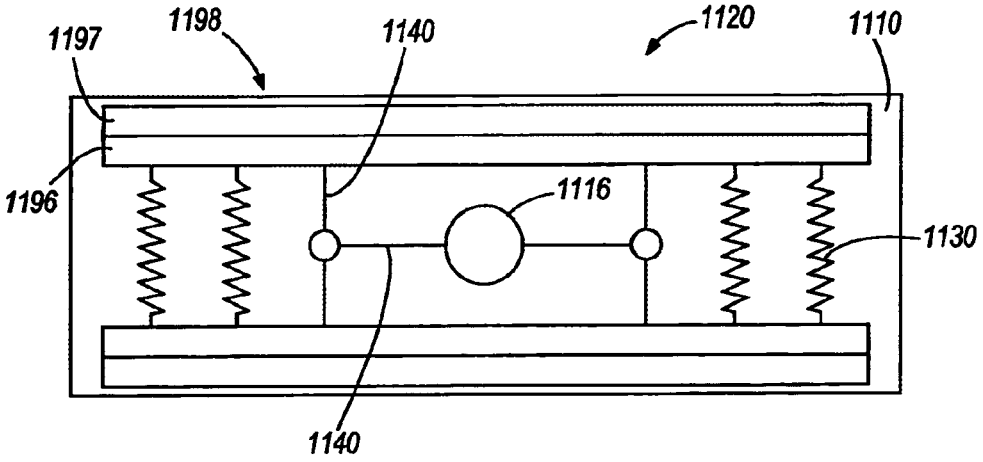
FIG. 26 is a schematic view of an actuator according to another embodiment of the present invention.

For example, in the actuator 1198 shown in FIG. 26, cables 1140 are connected to the clamping bars 1196, and are routed past any suitable posts, walls, rollers, or other elements of the mop head 1110 to the mop handle 1116, and can be pulled and/or pushed to move the clamping bars 1196. Biasing members 1130 (e.g., compression springs) connected to a pair of inner clamping bars 1196 can be used to bias the inner clamping bars 1196 outward for clamping protrusions or edges of a mop pad (not shown) against outer clamping bars 1197. The outer clamping bars 1197 can be separate elements attached to the mop head body or can be portions of the mop head body. As the cables 1140 are pulled by a remote user-manipulatable control on the mop handle 1116 (or alternatively, on the mop head 1110 in other embodiments), the inner bars 1196 can be drawn inward, permitting insertion or removal of mop pad protrusions for installation or removal of a mop pad, respectively. The cables 1140 can then be released by the user-manipulatable control, so that the biasing members 1130 can bias the inner clamping bars 1196 outward to clamp the mop pad protrusions or edges between the inner and outer clamping bars 1196, 1197.

Figure 27:
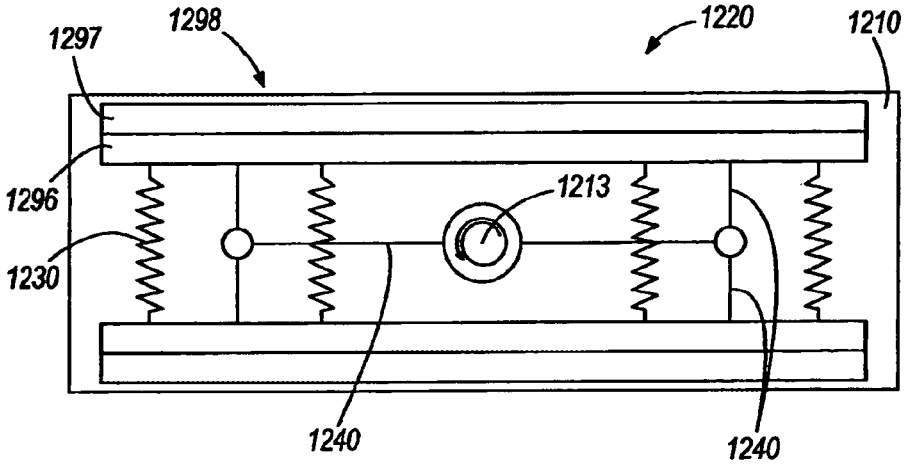
FIG. 27 is a schematic view of another embodiment of an actuator according to the present invention.

The actuator 1298 illustrated in FIG. 27 is similar to that shown in FIG. 26, but has biasing members 1230 located in a more distributed manner across the length of the clamping bars 1296, 1297 by way of example, has stationary inner clamping bars 1296 and movable outer clamping bars 1297, and also utilizes a handle twisting actuation force (e.g., see FIGS. 8-10) to actuate the movable clamping bars 1297. If desired, a torsion spring 1213 can be attached to cables 1240 extending and connected to the outer clamping bars 1297 so that the torsion spring 1213 can wind up the cable 1240 to draw the outer bars 1297 inward, thereby exerting a clamping force upon protrusions or edges of a mop pad. Still other examples of actuation and/or biasing mechanisms for moving one or more clamping bars are possible, and fall within the spirit and scope of the present invention.

FIGS. 28-31 illustrate various embodiments of the present invention in which mops each have a different type of user-manipulatable control for actuation of one or more of the actuators 98, 198, 289, 398, 498, 598, 698, 798, 898, 898', 998, 1098, 1098', 1198 illustrated in FIGS. 1-27. Each of these user-manipulatable controls 1319, 1419, 1519, 1619, 1719 is located on the mop handle 1316, 1416, 1516, 1616, 1716 remote from the mop head 1310, 1410, 1510, 1610, 1710, and provides the user with a convenient manner to actuate the actuator 98, 198, 289, 398, 498, 598, 698, 798, 898, 898', 998, 1098, 1098', 1198 connected to the user-manipulatable control 1319, 1419, 1519, 1619, 1719. In some embodiments, the user can therefore attach a new mop pad 1354, 1454, 1554, 1654, 1754 without raising the mop head 1310, 1410, 1510, 1610, 1710 and manipulating the raised mop head 1310, 1410, 1510, 1610, 1710 while attempting to secure the mop pad 1354, 1454, 1554, 1654, 1754 (a common practice with conventional mop designs). Also, in some embodiments the user need not necessarily touch the mop head 1310, 1410, 1510, 1610, 1710 and/or the mop pad 1354, 1454, 1554, 1654, 1754 to secure the mop pad 1354, 1454, 1554, 1654, 1754 thereto or to release a used mop pad 1354, 1454, 1554, 1654, 1754 therefrom (another common practice with conventional mop designs). This can be advantageous in cases where a used mop pad 1354, 1454, 1554, 1654, 1754 has been soiled with many particularly undesirable substances from certain areas, such as bathroom floors, pet areas, areas near refuse containers, and the like, has been soiled with particularly messy substances such as fluids, powder, staining substances (ink, dye, or toner), and the like, and in many other cases.

Figure 28:
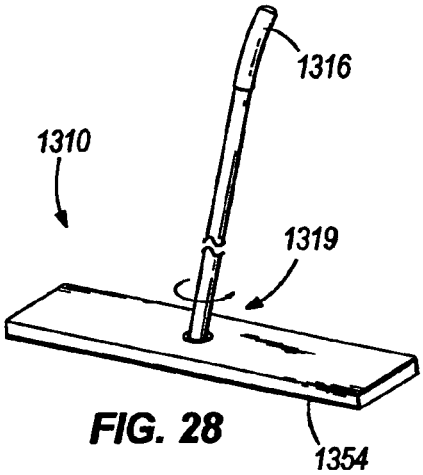
FIG. 28 is a perspective view of a mop head having a remote mechanical control according to an embodiment of the invention.

FIG. 28 illustrates a mop having a user-manipulatable control 1319 defined by the mop handle 1316 itself. In this embodiment, the mop handle 1316 can be pivoted about its own longitudinal axis, thereby generating actuation of a mop head actuator (not visible in FIG. 28), such as any of the actuators 398, 498, 898, 898', 1098, 1098', 1298 illustrated in FIGS. 6-10, 18-20, 24, and 25. As described in greater detail above, such actuation can generate release and/or attachment of the mop pad 1354 with respect to the mop head 1310.

Figure 29:
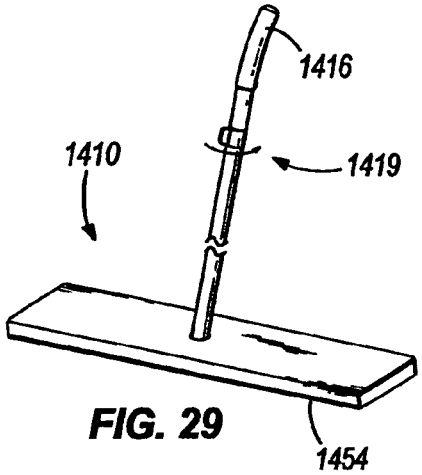
FIG. 29 is a perspective view of a mop head having a remote mechanical control according to another embodiment of the invention.

The user-manipulatable control shown in the embodiment of FIG. 29 is a lever 1419 that can be pivoted about the longitudinal axis of the mop handle 1416. This lever 1419 can be attached to a tube, rod, or other elongated member (not shown) within the mop handle 1416 and extending to the mop head 1410 for generating actuation of a mop head actuator in a manner similar to the embodiments described above in connection with FIG. 28. In other embodiments, this user-manipulatable control can have other shapes and sizes, such as an annular grip, a pin, boss, or other protrusion extending from the mop handle, and the like. To actuate a mop head actuator using the lever 1419, a user can hold the mop handle 1416 with one hand, and can pivot the lever 1419 about the longitudinal axis of the mop handle 1416, thereby generating release and/or attachment of the mop pad 1454 with respect to the mop head 1410.

Figure 30:
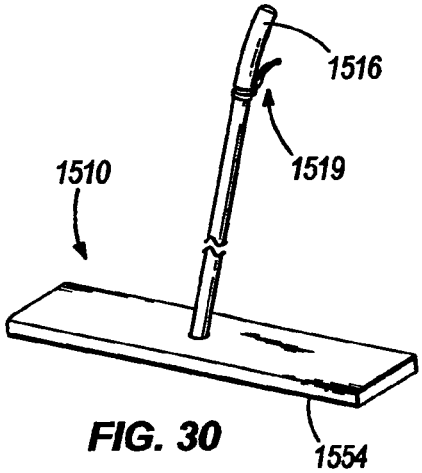
FIG. 30 is a perspective view of a mop head having a remote mechanical control according to another embodiment of the invention.

FIG. 30 shows a mop having a user-manipulatable control defined at least in part by a handle 1519 that can be squeezed against the mop handle 1516 in a manner similar to a bike brake handle. One or more cables (not visible in FIG. 30) capable of exerting pulling and/or pushing force can be attached to the handle 1519, and can extend down the mop handle 1516 to the mop head actuator, such as any of the actuators 98, 198, 298, 798, 998, 1198 illustrated in FIGS.

1-5, 15-17, 21-23, and 26. By manipulating the handle 1519 to which the cable(s) are attached, a user can therefore generate release and/or attachment of the mop pad 1554 with respect to the mop head 1510. Although the handle 1519 shown in FIG. 30 is oriented in a generally upward direction, it should be noted that the handle 1519 can be oriented on the mop handle 1516 in any other manner desired.

Figure 31:
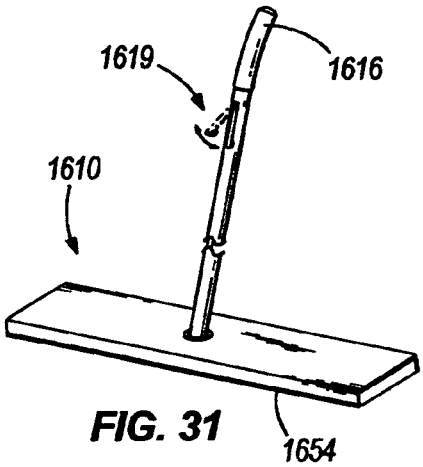
FIG. 31 is a perspective view of a mop head having a remote mechanical control according to another embodiment of the invention.

The user-manipulatable control shown in FIG. 31 is similar in many respects to that shown in FIG. 30. Accordingly, reference is hereby made to the description above in connection with FIG. 30 for more information regarding the user-manipulatable control illustrated in FIG. 31. The user-manipulatable control shown in FIG. 31 is a lever 1619 pivotably mounted to the mop handle 1616. The lever 1619 is connected to one or more cables (not visible in FIG. 30) capable of exerting pulling and/or pushing force and extending down the mop handle 1616 to the mop head actuator. The lever 1619 has a position in which the lever 1619 is received within a recess (e.g., a slot, depression, or other aperture) of the mop handle 1616 when not being actuated by a user. In order to attach and/or detach a mop pad 1654 with respect to the mop head 1610, a user grips the mop handle 1616, pivots the lever 1619 with respect to the mop handle 1616, and then pivots the lever 1619 back toward and into the recess on the mop handle 1616. Although the lever 1619 shown in FIG. 31 is oriented such that the lever 1619 pivots away from the mop handle 1616 in a generally upward direction, it should be noted that the lever 1619 can be oriented on the mop handle 1616 in any other manner desired.

Figure 32:
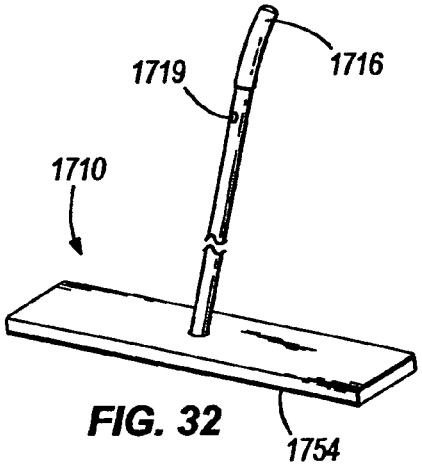
FIG. 32 is a perspective view of a mop head having a remote mechanical control according to another embodiment of the invention.

FIG. 32 illustrates a mop having a user-manipulatable control defined at least in part by an electrical button or switch 1719 on the mop handle 1716, and can instead take any of the other forms of electrical controls described above in connection with the embodiments of FIGS. 11-14. The button or switch 1719 can be manipulated by a user to activate a solenoid, motor, or other electric actuator connected to any of the mop head actuators described herein in order to attach or detach the mop pad 1754 with respect to the mop head 1710. In such embodiments, one or more batteries can be connected to the electric actuator for power the same. Alternatively or in addition, an electrical plug and/or suitable electric contacts can be connected to the electric actuator for powering the electric actuator or for charging one or more batteries with or without a docking station.

In other embodiments, a portion of one or more cables extending to any of the mechanical mop head actuators described herein can be accessible on the mop handle by a user, enabling the user to pull the cable(s) for attachment or release of a mop pad. For example, a cable can have a loop external to the mop handle for grasping and pulling or pushing by a user.

Although the remote user-manipulatable controls described above provide significant advantages for a user based upon the location of such controls on the mop handle, it should be noted that the same or similar controls can be located on the mop head. Such controls can still enable a user to attach and/or detach a mop pad without contact or with minimal contact with the mop pad.

In some embodiments, a combination of controls, such as two mechanical controls, one mechanical control and one electrical control, and the like, can be used to attach and detach a mop pad. In these embodiments, one control can be used to attach the mop pad to the mop head, whereas another control can be used to detach the mop pad from the mop head. Alternately, the user can choose between two or more controls based upon comfort and usability, such that the controls can be used interchangeably.

The embodiments of user-manipulatable controls described and illustrated herein are presented by way of example only, and are not intended to be an exhaustive list of possible controls. Other configurations or arrangements of user-manipulatable controls capable of actuating any of the mop head actuators described herein are possible, and fall within the spirit and scope of the present invention.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, in those embodiments of the present invention utilizing mop head grips as described above, any of such grips can be pushed to desired positions (e.g., extended in the embodiments of FIGS. 4, 5, and 8-10) by the use of certain types of cables (e.g., Bowden cables) capable of exerting both pushing and pulling forces upon the grips.

What is claimed is:

1. A mop adapted to be releasably coupled to a mop pad, the mop comprising:

a mop handle;

a mop head connected to the mop handle and including a mop head body, a first portion of the mop head movable with respect to a second portion of the mop head between a first position in which the first portion engages the mop pad to secure the mop pad to the mop head, and a second position in which the mop pad is released from the first portion, the first portion biased to extend into an exterior surface of the mop pad and movable to the first position to pull the mop pad taut across a bottom of the mop head; and a user-manipulatable control coupled to the first portion of the mop head, the user-manipulatable control operable by a user to actuate the first portion of the mop head to move the first portion to each of the first position and the second position, wherein the first portion is movable by an actuator located at least partially within the mop head body and controlled by the user-manipulatable control, and wherein the actuator includes a cable extending along the mop handle and coupled to the user-manipulatable control and the mop head portion.

2. The mop of claim 1, wherein the first portion is positioned on an underside of the mop head and positionable over the mop pad.

3. The mop of claim 1, wherein the first portion includes a grip engageable with the mop pad and biased to the first position.

4. The mop of claim 1, wherein the mop head is pivotable about a longitudinal axis of the mop handle to actuate the first portion.

5. The mop of claim 1, wherein the first portion includes a plurality of protrusions positioned to releasably engage a surface of the mop pad upon translational movement of the first portion with respect to the mop head body.

6. The mop of claim 1, wherein the first portion includes a wing extendable and retractable with respect to the mop head body.

7. The mop of claim 1, wherein the first portion is movable relative to the second portion to clamp part of the mop pad between the first and second portions.

8. A method of attaching a mop pad to a mop head of a mop, the method comprising:

manipulating a control coupled to the mop by twisting a handle of the mop;

transmitting force from the control to a first portion of the mop head;

moving the first portion in a first direction away from a second portion of the mop head in response to the force transmission;

extending the first portion into an exterior surface of the mop pad in response to movement of the first portion in the first direction; and pulling the mop pad taught across a bottom of the mop head in response to the first portion extending into the surface.

9. The method of claim 8, further comprising engaging a plurality of protrusions on the first portion with the surface of the mop pad such that the protrusions at least partially extend into the mop pad.

10. The method of claim 9, further comprising releasing the plurality of protrusions on the first portion from the mop pad by moving the first portion relative to the second portion in a second direction opposite the first direction.

11. The method of claim 8, wherein transmitting force from the control on the handle includes transmitting a pulling force upon a cable connected to the control to the first portion.

12. A mop adapted to be releasably coupled to a mop pad, the mop comprising:

a mop handle defining a plane extending longitudinally through the mop handle;

a mop head connected to the mop handle and including a mop head body, a portion of the mop head movable relative to the mop head body in a direction perpendicular to the plane between a first position in which the portion engages an exterior surface of the mop pad to secure the mop pad to the mop head, and a second position in which the mop pad is released from the portion, the portion of the mop head positionable over the mop pad and biased to the first position to pull the mop pad taut across a bottom of the mop head; and a user-manipulatable control on the mop handle and coupled to the portion of the mop head, the user-manipulatable control including a cable and operable by a user to actuate the portion of the mop head to each of the first position and the second position, the mop head portion movable between the first and second positions by manipulating the cable.

13. The mop of claim 12, wherein the mop head portion is positioned on an underside of the mop head and positionable over the mop pad.

14. The mop of claim 13, wherein the mop head portion includes a grip engageable with the mop pad and biased to the first position.

15. The mop of claim 12, wherein the mop head portion is biased to extend into a surface of the mop pad.

16. The mop of claim 12, wherein the mop head portion includes a plurality of protrusions positioned to releasably engage a surface of the mop pad upon translational movement of the first portion with respect to the mop head body.

17. A method of attaching a mop pad to a mop head of a mop, the method comprising:

manipulating a control coupled to the mop;

transmitting a pulling force upon a cable connected to the control to a first portion of the mop head;

moving the first portion in a first direction away from a second portion of the mop head in response to the force transmission;

extending the first portion into an exterior surface of the mop pad in response to movement of the first portion in the first direction; and pulling the mop pad taught across a bottom of the mop head in response to the first portion extending into the surface.

18. The method of claim 17, wherein manipulating the control includes twisting a handle of the mop.

19. The method of claim 17, further comprising engaging a plurality of protrusions on the first portion with the surface of the mop pad such that the protrusions at least partially extend into the mop pad.

20. The method of claim 19, further comprising releasing the plurality of protrusions on the first portion from the mop pad by moving the first portion relative to the second portion in a second direction opposite the first direction.

* * * * *